US007520579B2

(12) United States Patent
Yoshida

(10) Patent No.: US 7,520,579 B2
(45) Date of Patent: Apr. 21, 2009

(54) IMAGE FORMING APPARATUS HAVING DROPLET SPEED CONTROL

(75) Inventor: Takahiro Yoshida, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 198 days.

(21) Appl. No.: 11/546,812

(22) Filed: Oct. 11, 2006

(65) Prior Publication Data

US 2007/0080978 A1 Apr. 12, 2007

(30) Foreign Application Priority Data

Oct. 12, 2005 (JP) ..... 2005-297387

(51) Int. Cl.
*B41J 29/38* (2006.01)
*B41J 2/045* (2006.01)

(52) U.S. Cl. ..... 347/10; 347/9; 347/11; 347/14; 347/70

(58) Field of Classification Search ..... 347/10, 347/70, 9, 11, 14
See application file for complete search history.

(56) References Cited

U.S. PATENT DOCUMENTS 4,686,539 A 8/1987 Schmidle et al.
6,059,393 A 5/2000 Takahashi
6,151,050 A 11/2000 Hosono et al.

FOREIGN PATENT DOCUMENTS

EP 0737586 A1 10/1996
JP 2004-58606 2/2004
JP 2004-74500 3/2004
JP 2005-41039 2/2005

OTHER PUBLICATIONS

Apr. 14, 2008 European search report in connection with corresponding European patent application No. EP 06 25 5247.

*Primary Examiner*—Luu Matthew
*Assistant Examiner*—Jannelle M Lebron
(74) *Attorney, Agent, or Firm*—Cooper & Dunham, LLP

(57) ABSTRACT

An image forming apparatus includes a recording head, and a drive pulse generator. The recording head includes a nozzle to discharge a droplet of recording liquid, a pressure-generating room to store the recording liquid and communicate with the nozzle, and a pressure-generating device to change a pressure condition of the recording liquid in the pressure-generating room. The drive pulse generator generates a drive pulse pattern having a plurality of drive signals generated sequentially. The plurality of drive signals are selectively applied to the pressure-generating device, and include at least a first drive signal and a second drive signal, generated sequentially. A discharge speed of a droplet discharged by applying a combination of the first and second drive signals to the pressure-generating device is set to be slower than a discharge speed of a droplet discharged by applying only the second drive signal to the pressure-generating device.

15 Claims, 13 Drawing Sheets

IMAGE FORMING APPARATUS HAVING DROPLET SPEED CONTROL

TECHNICAL FIELD

The present disclosure generally relates to an image forming apparatus, and more particularly to an image forming apparatus having a recording head for discharging droplets of recording liquid.

BACKGROUND

An image forming apparatus is available as various types of apparatuses such as printer, facsimile apparatus, copier, plotter, and multifunctional apparatus (having printer/facsimile/copier functions), for example.

Such image forming apparatus may include a carriage having a recording head (or printing head), which can discharge droplets of recording liquid (e.g., ink).

Such carriage may be moved in a direction perpendicular to a transport direction of a recording medium in the image forming apparatus, for example. The recording medium includes a recording sheet, a transfer member, for example, wherein the recording sheet and transfer member includes a paper sheet.

Such recording medium may be transported intermittently into a sheet transport direction to record images on the recording medium. With such process, images can be formed or printed on the recording medium.

Such process can be conducted by an image forming apparatus of serial type, and an image forming apparatus having line type having line head. In the serial type, a recording head (e.g., inkjet head) may be moved in a given direction over a recording medium. In the line type, a recording medium may be moved in a given direction under a recording head (e.g., inkjet head), for example.

Such image forming apparatus may conduct gray-scale printing as mentioned below, for example.

A reference drive pulse pattern having a plurality of drive signals (or drive pulses) is generated for one-dot print cycle (or one-drive period). Then, one drive signal or some drive signals are selected from the reference drive pulse pattern.

Such selected signals can be transmitted to a pressure-generating device (e.g., actuator), which generates energy for discharging droplets from the recording head.

Based on the selected signals, the recording head may discharge droplets having a same droplet size or droplets having different droplet sizes, and such droplets may be impacted on a same impact position on a recording medium to form dots having different sizes.

In one background image forming apparatus, a plurality of discharge drive pulses for discharging droplets and a non-discharge drive pulse for vibrating a meniscus slightly (i.e., droplet is not discharged) are included for a drive pulse pattern used for one-dot print cycle (or one-drive period), wherein the plurality of discharge drive pulses may be output sequentially.

Such drive pulses may include a first signal for increasing a volume capacity of a pressure-generating room, a second signal for maintaining the increased volume capacity of the pressure-generating room after the first signal, and a third signal for contracting the volume capacity of the pressure-generating room after the second signal.

Another background image forming apparatus includes a drive signal generator, which generates a reference drive signal for bi-directional printing, in which a printing operation is conducted in one direction, and then a next printing operation is conducted in opposite direction.

The reference drive signal may include a first pulse and a second pulse generated sequentially. The first pulse may be used for discharging a liquid droplet at a relatively slower speed, and the second pulse may be used for discharging a liquid droplet at a relatively faster speed.

Further, a related art image forming apparatus may include a drive signal generating circuit and a recording head.

When the recording head is moved in a first direction for one printing operation, the drive signal generating circuit generates a first-type drive signal which may generate a discharge pulse for a medium-sized dot and a discharge pulse for a smaller dot, in this order.

When the recording head is moved in a second direction, opposite to the first direction, for a next printing operation, the drive signal generating circuit may generate a second-type drive signal which generates the discharge pulse for the medium-sized dot, for the smaller dot and the discharge pulse in this order, in which the drive signal generating circuit generates a minute-vibrate pulse between the smaller dot discharge pulse and medium-sized dot discharge pulse. The minute-vibrate pulse is supplied to a pressure generating element by a pulse supplying device before the medium-sized dot discharge pulse is generated after the smaller dot discharge pulse.

In general, an improvement such as concurrent improvement of high-speed printing and higher image quality may be demanded on an image forming apparatus.

In order to achieve such improvement on printing speed, a plurality of types of droplets may be discharged from the same nozzle, wherein the plurality of types of droplets use different amounts of recording liquid (e.g., ink). Specifically, a drive pulse pattern having a plurality of drive signals may be generated for one-dot print cycle (or one-drive period), and the drive signals selectively applied to form different sized dots such as smaller to larger dots.

It is preferable to shorten the one-dot print cycle (or one-drive period) to improve a printing speed to a higher speed.

However, if the one-dot print cycle (or one-drive period) is shortened, numbers of drive signals to be included in a drive pulse pattern may become smaller, by which it may become difficult to discharge a various types of droplets in one-dot print cycle (or one-drive period).

Further, in order to realize a higher image quality, it is preferable to merge a plurality of droplets as one droplet when the droplets are traveling through the air and to impact the one droplet to the recording medium compared to impacting a plurality of droplets on a same impact position on the recording medium, one by one.

Accordingly, in order to achieve high-speed printing and higher image quality concurrently, there is a need for improvement of drive pulse pattern and improvement of precision of impact position on the recording medium by a plurality of droplets.

In the above-mentioned another background image forming apparatus, a discharge speed of droplet by the first drive pulse is set to be relatively slower, and a discharge speed of droplet by a second drive pulse is set to be relatively faster, wherein the first drive pulse is applied before the second drive pulse.

With such speed adjustment for droplet, a discharge speed of droplet can be set greater for a later-discharged droplet than an earlier-discharged droplet so that the earlier-discharged droplet and the later-discharged droplet can impact on the same impact position on a recording medium.

However, if a larger droplet is to be discharged by one drive signal, a droplet amount that can be discharged by the one drive signal may have a limitation.

Further, when a larger dot is formed with a plurality of drive signals, an image quality may degrade because such plurality of droplets may be impacted on a recording medium one by one to form one dot.

Further, in the above-mentioned related art image forming apparatus, different drive signals may be required for conducting a printing operation in the first and second direction, which is opposite each other. Further, a higher image quality may not be obtained for a larger dot because the smaller dot and medium-sized dot may impact on different positions when forming the larger dot on the recording medium.

SUMMARY

The present disclosure relates to an image forming apparatus including a recording head, and a drive pulse generator. The recording head includes a nozzle to discharge a droplet of recording liquid, a pressure-generating room to store the recording liquid and communicate with the nozzle, and a pressure-generating device to change a pressure condition of the recording liquid in the pressure-generating room. The drive pulse generator generates a drive pulse pattern having a plurality of drive signals generated sequentially. The plurality of drive signals are selectively applied to the pressure-generating device, and include at least a first drive signal and a second drive signal, generated sequentially. A discharge speed of a droplet discharged by applying a combination of the first and second drive signals to the pressure-generating device is set relatively slower than a discharge speed of a droplet discharged only by applying the second drive signal to the pressure-generating device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS

Figure 1:
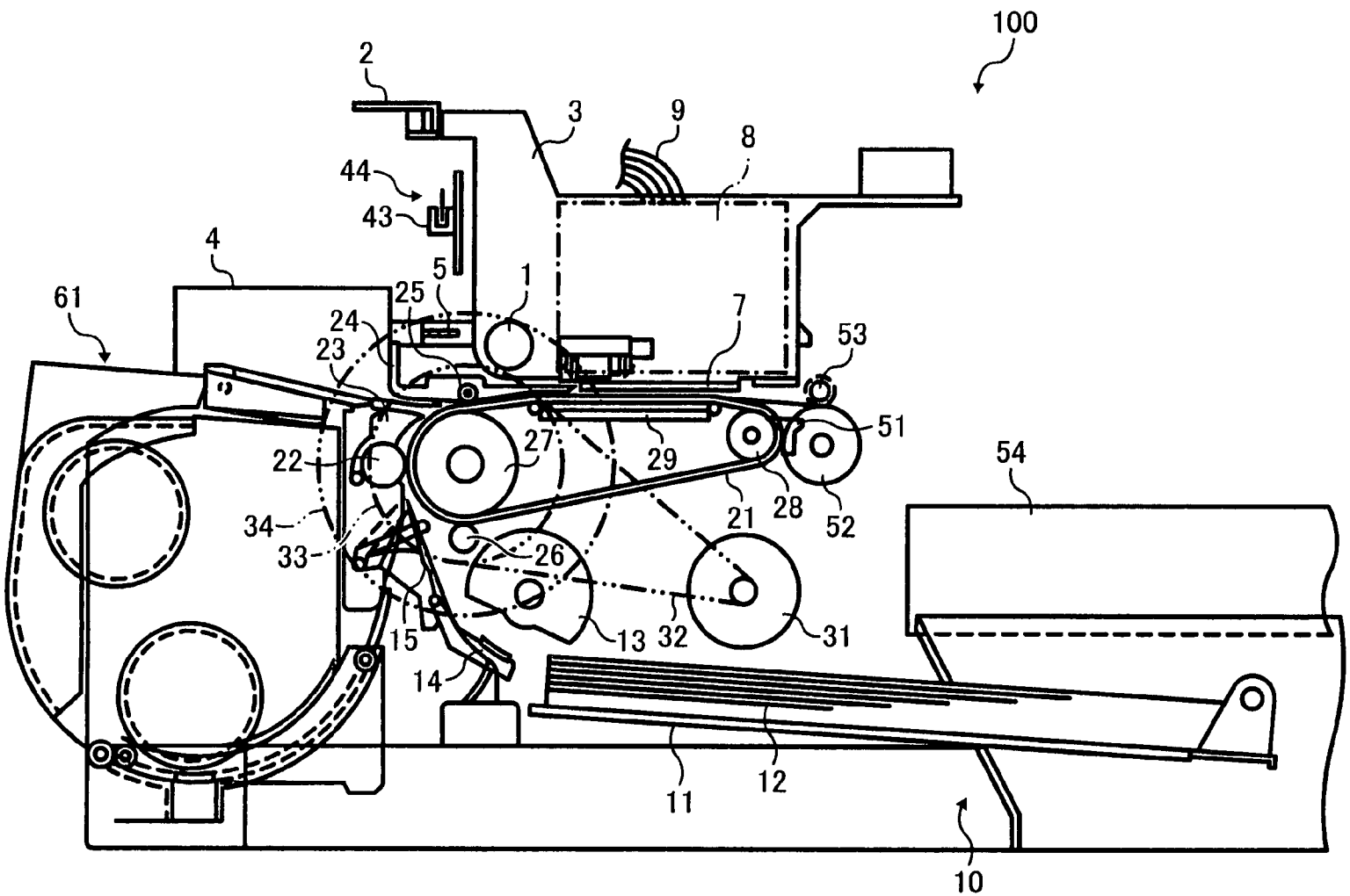
FIG. 1 is a schematic configuration view of an image forming apparatus according to an exemplary embodiment of this disclosure.

In describing exemplary embodiments shown in the drawings, specific terminology is employed for the sake of clarity. However, the present disclosure is not intended to be limited to the specific terminology so selected and it is to be understood that each specific element includes all technical equivalents that operate in a similar manner.

Figure 2:
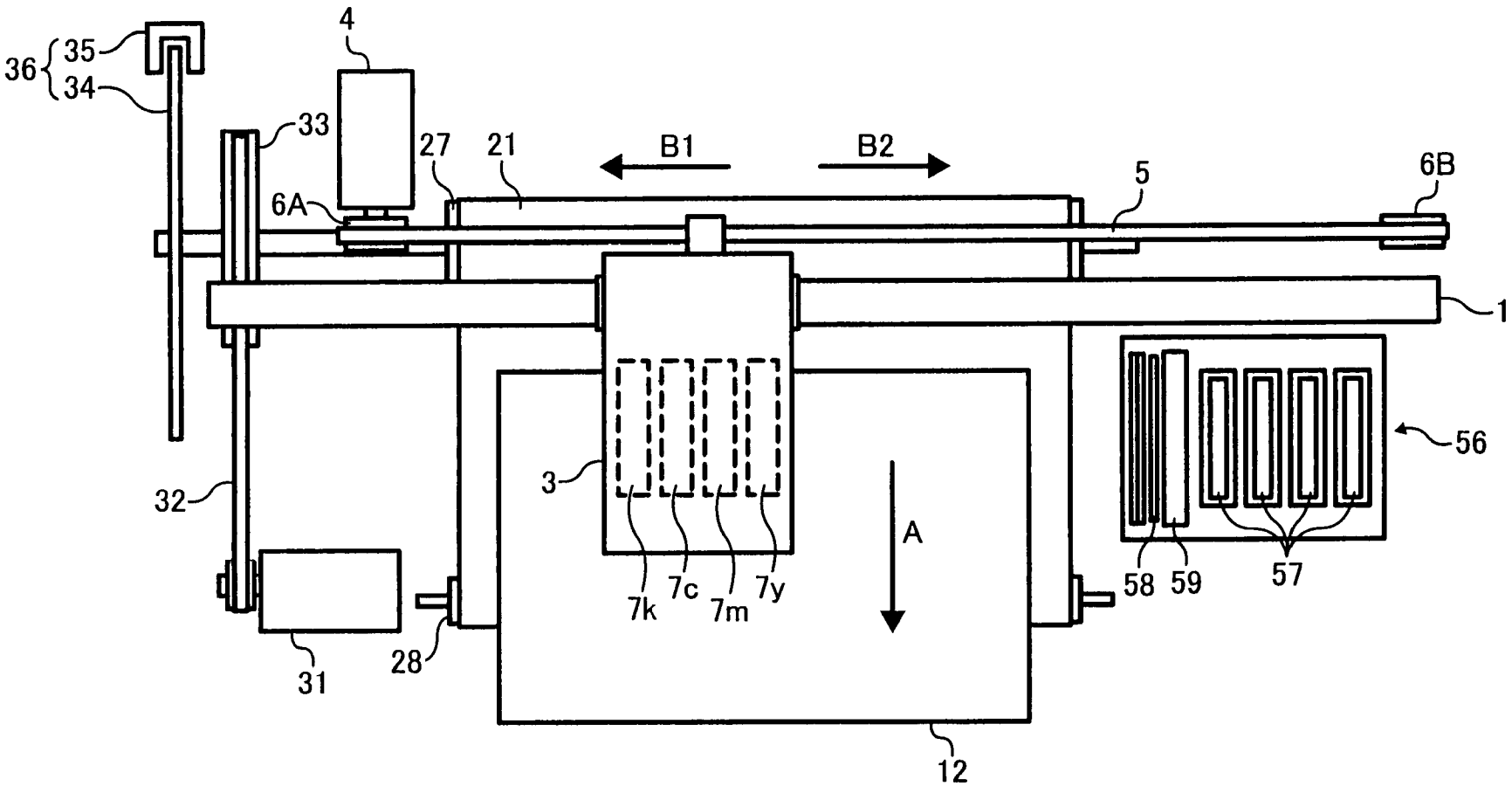
FIG. 2 is a schematic configuration view of a recording section in the image forming apparatus of FIG.

Referring now to the drawings, wherein like reference numerals designate identical or corresponding parts throughout the several views, an image forming apparatus according to an exemplary embodiment is described with particular reference to FIGS. 1 to 2.

FIG. 1 is a schematic view explaining a configuration of an image forming apparatus 100 according to the exemplary embodiment. FIG. 2 is a plan view of a recording section of the image forming apparatus 100.

As shown in FIG. 1, the image forming apparatus 100 includes a guide rod 1 and guide rail 2, extended between each side plate of the image forming apparatus 100.

A carriage 3 can be moved in a main scanning direction in the image forming apparatus 100 with a guide of the guide rod 1 and guide rail 2.

Specifically, the carriage 3 can be slidably moved in a main scanning direction shown by arrows B1 and B2 in FIG. 2 with a first motor 4, a timing belt 5, a drive pulley 6A, and a driven pulley 6B. As shown in FIG. 2, the timing belt 5 is extended between the drive pulley 6A and driven pulley 6B.

As shown in FIG. 1, the carriage 3 includes a recording head 7. In this exemplary embodiment, the recording head 7 includes four recording heads 7*y*, 7*c*, 7*m*, and 7*k* corresponding to respective colors of yellow(Y), cyan(C), magenta(M), and black(K), for example, as shown in FIG. 2.

Further, the recording head 7 includes a plurality of nozzles for discharging droplets of recording liquid (e.g., ink). The plurality of nozzles are arranged in a direction perpendicular to a main scanning direction of a recording medium, and may discharge droplets in a downward direction in FIG. 1.

As shown in FIG. 1, the carriage 3 includes a sub-tank 8 for supplying recording liquid (e.g., ink) of different colors to each of the recording heads 7*y*, 7*c*, 7*m*, and 7*k*.

The sub-tank 8 can be connected to a main tank (not shown) such as ink cartridge via a supply tube 9 so that the recording liquid (e.g., ink) can be supplied from the main tank to the sub-tank 8.

As shown in FIG. 1, a sheet feed section includes a sheet cassette 10, a sheet stack 11, a sheet 12, a sheet feed roller 13 shaped in half-moon, and a separation pad 14 made of material having a larger friction coefficient. The separation pad 14 is biased toward the sheet feed roller 13.

The sheet feed roller 13 and the separation pad 14, which face each other, are used to feed the sheet 12 one by one to a transport section (to be described later) from the sheet stack 11. As shown in FIG. 1, a plurality of sheets (i.e., sheet 12) can be stacked on the sheet stack 11 of the sheet cassette 10.

As shown in FIG. 1, the transport section includes a transport belt 21, a guide 15, a counter roller 22, a transport guide 23, a press member 24, a pressure roller 25, and a charge roller 26.

The transport section transports the sheet 12 from the sheet feed section to a recording section (to be described later) in the image forming apparatus 100.

The sheet 12 is fed from the sheet feed section with a guide effect of the guide 15, and then the sheet 12 is sandwiched by the counter roller 22 and the transport belt 21.

The charge roller 26 can charge the transport belt 21 so that a surface of transport belt 21 can electro-statically adhere the sheet 12 thereon and transport the sheet 12 to the recording section.

The transport guide 23 is used to change a transport direction of the sheet 12, for example, in a 90-degrees so that the sheet 12 can follow a movement direction of the transport belt 21.

The press member 24 biases the pressure roller 25 towards the transport belt 21, and then the pressure roller 25 biases the sheet 12 towards the surface of the transport belt 21.

As shown in FIG. 1, the transport belt 21 is an endless type belt and is extended by a transport roller 27 and a tension roller 28.

As shown in FIG. 2, the image forming apparatus 100 includes a second motor 31, a timing belt 32, and a timing roller 33 for rotating the transport roller 27. With a rotation of the transport roller 27, the transport belt 21 can move in a direction shown by an arrow A in FIG. 2.

The charge roller 26 can contact the transport belt 21 and is rotated with movement of the transport belt 21.

As shown in FIG. 1, a guide member 29 is provided on an inner face of the transport belt 21, and faces a printing area of recording head 7.

Further, as shown in FIG. 2, the image forming apparatus 100 includes a rotary encoder 36 having a circular disc 34, and a sensor 35.

The circular disc 34 having a slit is attached to a shaft of the transport roller 27, and the sensor 35 detects the slit of the circular disc 34 when the circular disc 34 rotates with the transport roller 27.

After a printing operation is conducted to the sheet 12 by the recording head 7, the sheet 12 is ejected to a tray 54 by an ejection unit.

The ejection unit includes a separation claw 51, and ejection rollers 52 and 53. The separation claw 51 separates the sheet 12 from the transport belt 21.

The image forming apparatus 100 can further include a sheet-inverting unit 61 on a rear side of the image forming apparatus 100 as shown in FIG. 1. The sheet-inverting unit 61 may be detachable from the image forming apparatus 100.

The sheet-inverting unit 61 receives the sheet 12 from the transport belt 21 when the transport belt 21 travels in a direction opposite to the direction shown by an arrow A, and inverts faces of the sheet 12. Then the sheet-inverting unit 61 feeds the face-inverted sheet 12 to a space between the counter roller 22 and the transport belt 21.

Further, as shown in FIG. 2, a refreshing unit 56 is provided on one side end of the image forming apparatus 100. The refreshing unit 56 is used to maintain a nozzle condition and to refresh the nozzle of the recording head 7.

As shown in FIG. 2, the refreshing unit 56 includes a capping member 57, a wiping blade 58, a dummy discharge receiver 59, for example.

The capping member 57 is used for capping a nozzle face of the recording head 7. The wiping blade 58 wipes the nozzle face of the recording head 7.

The dummy discharge receiver 59 is used for receiving droplets when a dummy discharging operation is conducted. The dummy discharging operation is conducted by discharging fresh recording liquid (e.g., ink) from the nozzle without actual printing, by which viscosity-increased ink adhered on the nozzle of the recording head 7 may be removed.

In the image forming apparatus 100, the sheet feed section feeds the sheet 12 one by one to the transport section.

Then, the sheet 12 is guided by the guide 15, and transported to the space between the counter roller 22 and transport belt 21. Then, the sheet 12 is guided by the transport guide 23 and pressed to the transport belt 21 by the pressure roller 25.

During such sheet transportation, a control circuit (not shown) supplies a positive voltage and negative voltage current to the charge roller 26 from a high voltage power source (not shown) alternately. Therefore, the transport belt 21 is alternately charged with positive and negative voltages, thereby positive voltage charged areas and negative voltage charged areas may be formed on the transport belt 21 alternately.

When the sheet 12 is fed on such charged transport belt 21, the sheet 12 may be electro-statically adhered on the transport belt 21, and is transported to the recording section with movement of the transport belt 21.

As shown in FIG. 2, the carriage 3 having the recording head 7 can be moved in a direction shown by arrows B1 or B2 over the sheet 12.

The recording head 7 discharges droplets (e.g., ink droplets) onto the sheet 12 to record one line image on the sheet 12 when the carriage 3 moves in a direction shown by arrows B1 or B2.

Transportation of the sheet 12 is stopped when one line image is recorded on the sheet 12.

When the recording of one line image completes, the sheet 12 is transported for a given distance and another one line image is recorded on the sheet 12 by discharging droplets (e.g., ink droplets) onto the sheet 12. Such recording process is repeated for one page. When such recording operation is completed for one page, the sheet 12 is ejected to the tray 54.

The image forming apparatus 100 can record images on both faces of the sheet 12 as below.

When the image forming apparatus 100 records an image on one face of the sheet 12, the transport belt 21 is rotated in an inverse direction to transport the sheet 12 to the sheet-inverting unit 61, wherein the sheet-inverting unit 61 inverts faces of the sheet 12. Then the sheet-inverting unit 61 feeds the face-inverted sheet 12 to the space between the counter roller 22 and the transport belt 21.

Then, the transport belt 21 transports the sheet 12 to the recording section, and another image is recorded on an opposite face of the sheet 12 with the above-described printing method, and then the sheet 12 is ejected to the tray 54.

During a standby mode of the image forming apparatus 100, at which no recording is conducted, the carriage 3 may be moved to the refreshing unit 56.

During such standby mode, the capping member 57 may cap the recording head 7 to maintain the nozzle in a wet condition. By capping the recording head 7 with the capping member 57, a discharge malfunction caused by dried nozzle can be prevented.

Further, a refreshing operation such as ejection of viscosity-increased ink and gas from the nozzle of the recording head 7 can be conducted by suctioning recording liquid (e.g., ink) from the nozzle while capping the recording head 7 with the capping member 57.

In addition, the wiping blade 58 may wipe the nozzle face of the recording head 7 to remove recording liquid (e.g., ink) adhered on the nozzle face of the recording head 7 after such refreshing operation.

Further, a dummy discharging operation, in which recording liquid (e.g., ink) is discharged from the nozzle of the recording head 7 while actual recording is not conducted, can be conducted before starting the recording operation or during recording operation. With such dummy discharging operation, discharge-ability of the recording head 7 can be maintained at a stable level.

Figure 3:
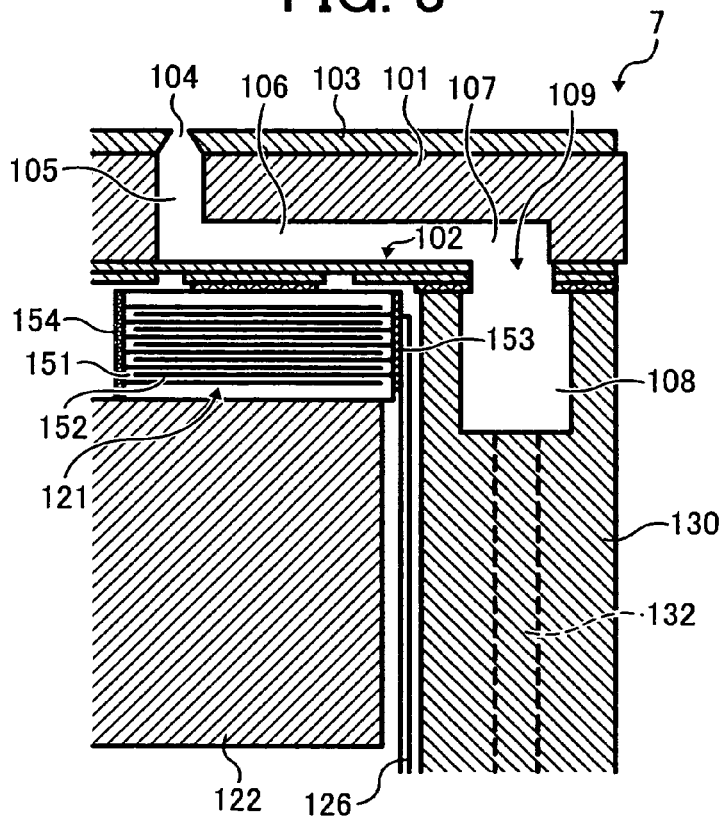
FIG. 3 is a cross-sectional view of a recording head of an image forming apparatus of FIG. 1.
Figure 4:
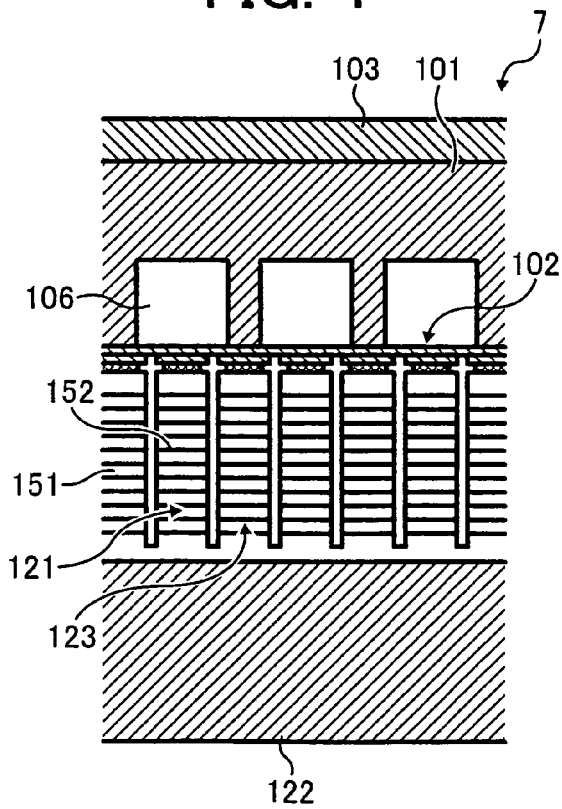
FIG. 4 is another cross-sectional view of the recording head of FIG. 3.

Hereinafter, the recording head 7 is explained with reference to FIGS. 3 and 4. FIGS. 3 and 4 are cross-sectional views of the recording head 7 of the image forming apparatus 100.

As shown in FIG. 3, the recording head 7 includes a channel board 101, a vibration plate 102, and a nozzle plate 103, for example.

The channel board 101 can be made by anisotropic etching process to a single crystal silicon substrate, for example. The vibration plate 102 can be made by electroforming process to a nickel plate, for example, and the vibration plate 102 can be bonded on a lower face of the channel board 101. The nozzle plate 103 can be bonded on an upper face of the channel board 101.

As shown in FIG. 3., the channel board 101, vibration plate 102, and nozzle plate 103 are layered, one over the other, each other to form the recording head 7.

As shown in FIG. 3, the nozzle plate 103 includes a nozzle 104, from which a droplet (e.g., ink droplet) is discharged.

As shown in FIG. 3, the nozzle 104 is communicated to a nozzle communication path 105, a liquid room 106, a supply path 107, an ink supply port 109, and a common liquid room 108.

Recording liquid (e.g., ink) can be supplied from the common liquid room 108 to the supply path 107 via the ink supply port 109. Then, the recording liquid goes to the liquid room 106, functioning as pressure-generating room, and then goes to the nozzle communication path 105 which is communicated to the nozzle 104.

Further, the recording head 7 includes a piezoelectric element 121, and a base substrate 122 as shown in FIG. 3.

The piezoelectric element 121 is used to deflex the vibration plate 102 to pressurize recording liquid (e.g., ink) in the liquid room 106.

In other words, the piezoelectric element 121 is used as pressure-generating device (or actuator), which converts an electric signal applied to the piezoelectric element 121 into a physical movement of the vibration plate 102.

Figure 6:
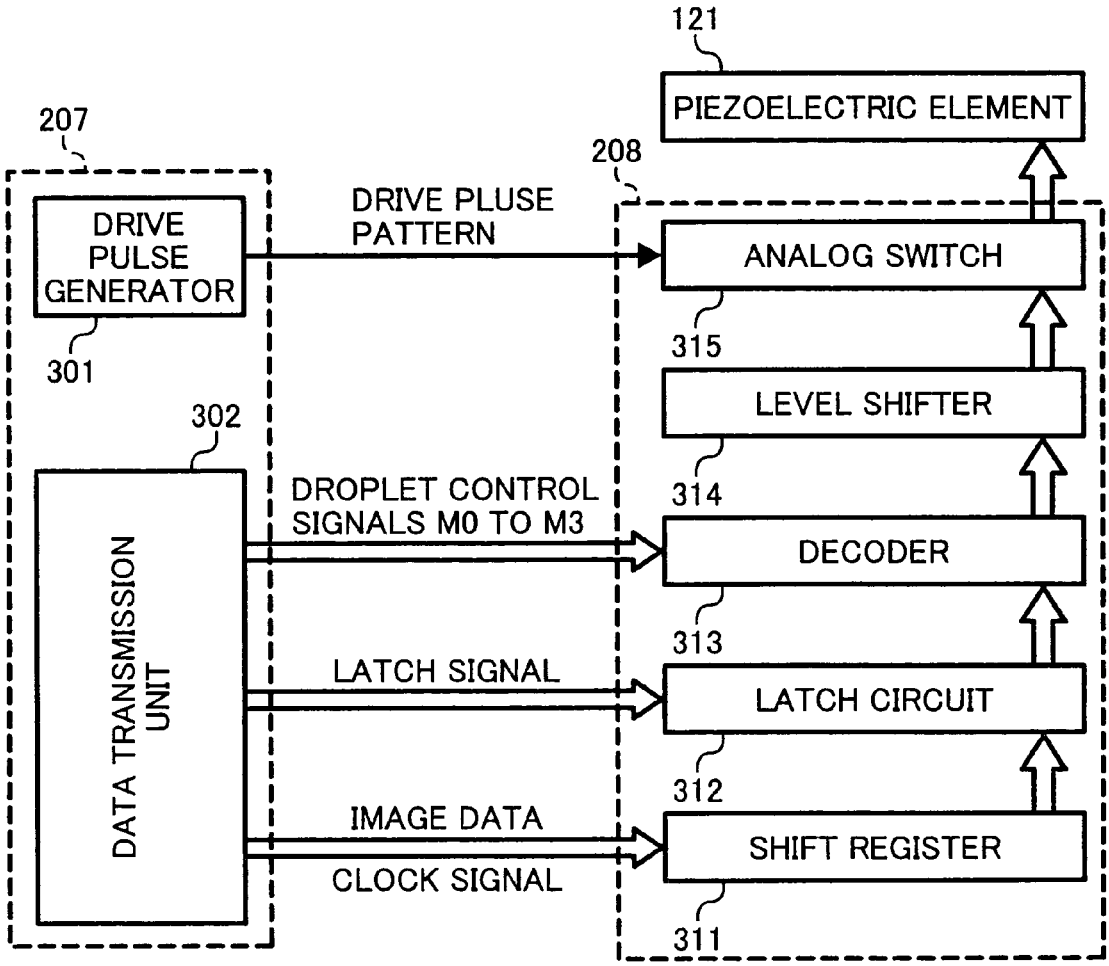
FIG. 6 is a block diagram of a print control unit and a head driver for the image forming apparatus of FIG. 1.

In an exemplary embodiment, the piezoelectric element 121 includes a two-layer structure to function as pressure-generating device. In FIG. 6, the piezoelectric element 121 is shown as one-layer structure for simplifying the drawing.

The base substrate 122 supports and fixes the piezoelectric element 121 thereon.

Further, as shown in FIG. 4, a supporter 123 is provided between each of the piezoelectric element 121. The supporter 123 can be formed with the piezoelectric element 121 by processing a piezoelectric element material. However, a drive voltage is applied only to the piezoelectric element 121 but not to the supporter 123. The supporter 123 is used for supporting the piezoelectric element 121.

Further, the piezoelectric element 121 is connected to a drive circuit (not shown) via a cable 126 such as flexible printed circuit cable.

As shown in FIG. 3, the vibration plate 102 is bonded to a frame member 130. The frame member 130 includes an ink supply path 132 as shown in FIG. 3.

The frame member 130 can contain the piezoelectric element 121 and base substrate 122 as shown in FIG. 3 as actuator unit.

The ink supply path 132 is used to supply recording liquid (e.g., ink) to the common liquid room 108 from an external liquid container. As shown in FIG. 3, the common liquid room 108 can be formed in the frame member 130.

The frame member 130 can be made of a material such as thermosetting resin (e.g., epoxy resin) and polyphenylene sulphide with an injection molding method, for example.

The channel board 101 can be made of a single crystal silicon substrate having a given crystal face orientation such as (110), for example.

The nozzle communication path 105 and liquid room 106 can be formed in the channel board 101 by conducting anisotropic etching with alkaline etching solution such as potassium hydroxide (KOH) solution to the channel board 101.

Further, the channel board 101 can be made of other material such as stainless plate and photosensitive resin, for example.

The vibration plate 102 can be made by an electroforming process to a metal plate such as nickel plate, for example. Further, the vibration plate 102 can be made by bonding a metal plate and resin plate. The vibration plate 102 is bonded on the piezoelectric element 121 and supporter 123, and further bonded on the frame member 130 as shown in FIG. 3.

The nozzle 104 can be formed in the nozzle plate 103 with a diameter of 10 to 30 μm, for example. The nozzle plate 103 can be bonded on the channel board 101 as shown in FIG. 3.

The nozzle plate 103 includes a metal material for making a nozzle, a middle layer formed on the metal material, and a water repellent layer formed on the middle layer. A surface of the nozzle plate 103 becomes a nozzle face of the recording head 7, which is mentioned in the above.

The piezoelectric element 121 can be made by alternately stacking a piezoelectric material 151 and an internal electrode 152 as shown in FIGS. 3 and 4.

As shown in FIG. 3, the piezoelectric element 121 is sandwiched by a discrete electrode 153 and a common electrode 154, which are provided on each end side of the piezoelectric element 121.

Accordingly, the internal electrode 152, which extend along the piezoelectric element 121, can be connected to the discrete electrode 153 or common electrode 154.

In general, a piezoelectric element can be deformed in two directions when an electric field is applied to the piezoelectric element. Specifically, the piezoelectric element may elongate in one direction (d33 direction) and contract in another direction (d31 direction) when an electric field is applied to the piezoelectric element.

In an exemplary embodiment, the piezoelectric element 121 may use deformation in the d33 direction or d31 direction, as required, to pressurize recording liquid (e.g., ink) in the liquid room 106.

Further, the recording head 7 can use a configuration including a base substrate 122 and one line of piezoelectric element 121.

The recording head 7 can be used as a discharge head as below.

The piezoelectric element 121 may contract itself when a first voltage, which is lower than a reference voltage, is applied to the piezoelectric element 121. With a contraction of the piezoelectric element 121, the vibration plate 102 may move in a downward direction in FIG. 3, by which the liquid room 106 may increase its volume capacity.

With the increased volume capacity of the liquid room 106, recording liquid (e.g., ink) can be supplied to the liquid room 106 from the common liquid room 108.

Then, the piezoelectric element 121 is applied with a second voltage, which is larger than the first voltage, to deform the piezoelectric element 121 in an upward direction in FIG. 3. With such deformation of the piezoelectric element 121, the vibration plate 102 moves in a direction toward the nozzle 104, by which the volume capacity of the liquid room 106 becomes smaller.

Then, the recording liquid (e.g., ink) in the liquid room 106 can be pressurized and discharged as a droplet of the recording liquid (e.g., ink) from the nozzle 104.

Then, by resetting a voltage to be applied to the piezoelectric element 121 to the reference voltage, the vibration plate 102 starts to return to an original shape (or position). During such process for resetting the voltage to the reference voltage, the liquid room 106 returns to an original volume capacity.

Accordingly, a negative pressure occurs in the liquid room 106, by which the recording liquid can be refilled into the liquid room 106 from the common liquid room 108.

When a vibration of meniscus in the nozzle 104 can be dampened and stabilized over time, the recording head 7 can be prepared for a next droplet discharge.

In the above-described exemplary embodiment, the recording head 7 is driven by firstly contracting the piezoelectric element 121 and secondly elongating the piezoelectric element 121.

However, the recording head 7 can be driven by an other method, such as firstly elongating the piezoelectric element 121 and secondly contracting the piezoelectric element 121, for example, by adjusting a drive pulse pattern to be applied to the piezoelectric element 121.

Hereinafter, a control unit for the image forming apparatus 100 is explained with reference to FIG. 5.

Figure 5:
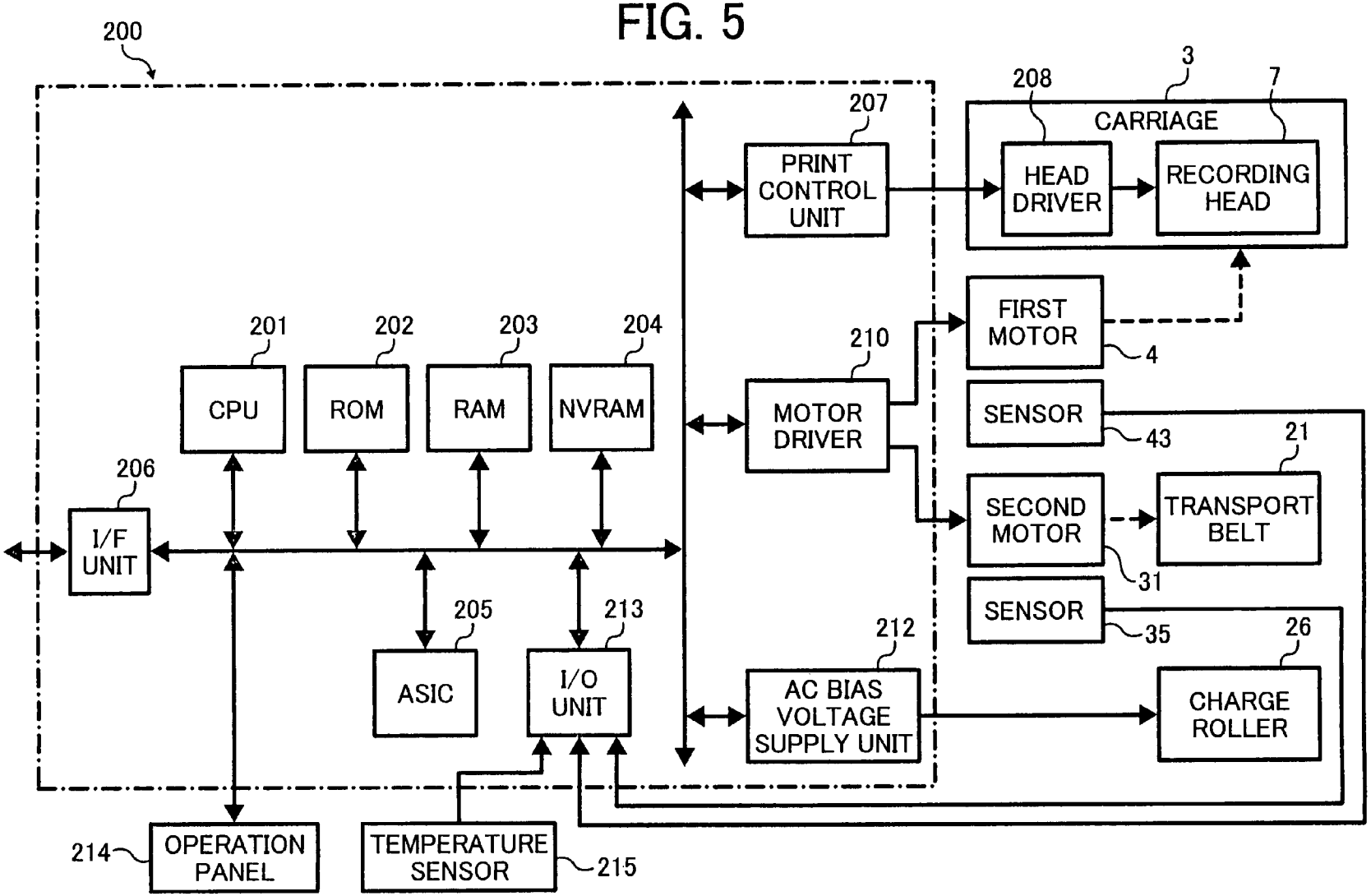
FIG. 5 is a block diagram of a control unit for an image forming apparatus of FIG. 1.

As shown in FIG. 5, the control unit 200 includes a CPU (central processing unit) 211, a ROM (read only memory) 202, a RAM (random access memory) 203, a NVRAM (non-volatile random access memory) 204, and an ASIC (application specific integrated circuit) 205, for example.

The CPU 211 controls the image forming apparatus 100 as a whole.

The ROM 202 stores programs used by the CPU 211, and other data. The RAM 203 stores image data or the like temporarily. The NVRAM 204 can rewritably retain data and store data when the image forming apparatus 100 is shut off from a power source.

The ASIC 205 controls signal-processing for image data, image-processing such as sorting of data, and input/output signal-processing for controlling the image forming apparatus 100.

As shown in FIG. 5, the control unit 200 further includes an I/F (interface) unit 206, a print control unit 207, a head driver 208, a motor driver 210, an AC (alternate current) bias voltage supply unit 212, and an I/O (input/output) unit 213, for example.

The I/F unit 206 is used to communicate data and signal with a host apparatus such as personal computer.

The control unit 207 includes a data transfer unit used for controlling the recording head 7, and a drive pulse generator for generating drive pulses.

The head driver 208 includes an integrated circuit to drive the recording head 107 in the carriage 3.

The motor driver 210 drives the first motor 4 and second motor 31.

The AC bias voltage supply unit 212 supplies AC bias voltage to the charge roller 26.

The I/O (input/output) unit 213 is used to receive signals from sensors 43 and 35, and a temperature sensor 215, and output such signals to the control unit 200.

Further, the control unit 200 is connected to an operation panel 214 for inputting and displaying information for operating the image forming apparatus 100.

The control unit 200 receives print data from a host apparatus such as a personal computer, an image scanner, and an image taking apparatus (e.g., digital camera) via the I/F unit 206, which is connected to the host apparatus via a cable or Internet, for example.

The CPU 201 reads out print data from a buffer memory in the I/F unit 206 and analyses the print data. Then, the ASIC 205 conducts image processing, and data sorting processing.

Then, the image data is transmitted from the print control unit 207 to the head driver 208.

In an exemplary embodiment, a printer driver in the host apparatus generates dot pattern data for image output.

The print control unit 207 transmits the above-mentioned image data as serial data.

The print control unit 207 outputs a transfer clock signal, latch signal, and droplet control signal (i.e., mask signal) to the head driver 208, wherein such signals are used for transmitting the image data and confirming a transmission of the image data.

Further, the print control unit 207 includes a D/A (digital/analog) converter, a drive pulse generator 301 (see FIG. 6), and a drive pulse pattern selector, for example.

The D/A converter converts pattern data for drive signal, stored in the ROM 202, from digital to analog data.

The drive pulse generator 301 includes a voltage amplifier and current amplifier, for example.

The drive pulse pattern selector selects a drive pulse pattern to be transmitted to the head driver 208.

The drive pulse generator 301 generates a drive pulse pattern having only one drive pulse (or drive signal) or a plurality of drive pulses (or drive signals), and outputs the drive pulse pattern to the head driver 208.

The head driver 208 serially receives image data for one line by one line to record the image data on a recording medium with the recording head 7.

The head driver 208 transmits the drive signals to the recording head 7 to energize the piezoelectric element 121 so that droplets can be discharged from the recording head 7.

By selecting drive pulses, which consist a drive pulse pattern, a various size of droplets such as large-sized droplet, medium-sized droplet, small-sized droplet can be selectively discharged from the recording head 7.

Further, the CPU 201 receives detection signals from the sensor 43 of a linear encoder 44 (see FIG. 1) to detect a moving speed and position of the carriage 3 in a direction shown by an arrows B1 or B2 (FIG. 2). The linear encoder 44 may be attached to the carriage 3. With such speed and position information of the carriage 3, the CPU 201 may determine a cycle of a drive pulse pattern.

The CPU 201 compares such detected moving speed and position data with speed/position profile data (e.g., target speed and position) stored in the ROM 202.

Based on such comparison, the CPU 201 can compute an output value for controlling the first motor 4, and drives the first motor 4 via the motor driver 210 with such output value.

In a similar way, the CPU 201 receives signals from the sensor 35 of the rotary encoder 36 to detect a moving speed and position of the transport belt 21 in a direction shown by an arrow A (FIG. 2).

The CPU 201 compares such detected moving speed and position data with speed/position profile data (e.g., target speed and position) stored in the ROM 202.

Based on such comparison, the CPU 201 can compute an output value for controlling the second motor 31, and drives the second motor 31 via the motor driver 210 with such output value.

Hereinafter, the print control unit 207 and head driver 208 are explained with reference to FIG. 6.

As shown in FIG. 6, the print control unit 207 includes a drive pulse generator 301, and a data transmission unit 302.

The drive pulse generator 301 generates a drive pulse pattern (e.g., reference drive pulse pattern) having a plurality of drive pulses (or drive signals) for one-dot print cycle (or one-drive period).

The data transmission unit 302 outputs two-bit image data (e.g., gray-scale signal expressed by 0 and 1) corresponding to images to be printed, clock signals, latch signals (LAT), and droplet control signals M0 to M3.

The droplet control signal is a two-bit signal, which is used to instruct an opening/closing of an analog switch 315 (to be described later) in the head driver 208 for each droplet to be discharged.

The droplet control signal shifts to an H (high) level (e.g., ON state) when the droplet control signal is selected based on the reference drive pulse pattern, and shifts to an L (low) level (e.g., OFF state) when the droplet control signal is not selected.

As shown in FIG. 6, the head driver 208 includes a shift register 311, a latch circuit 312, a decoder 313, a level shifter 314, and an analog switch 315.

The shift register 311 receives a clock signal (e.g., shift clock signal) and serial image data (gray-scale data of two-bit) from the data transmission unit 302.

The latch circuit 312 latches register values received from the shift register 311 with latch signals.

The decoder 313 decodes the gray-scale data and droplet control signals M0 to M3, and outputs a result value to the level shifter 314.

The level shifter 314 converts a logic level voltage signal received from the decoder 313 to a voltage signal, which can be used in the analog switch 315.

The analog switch 315 is shifted to ON or OFF (i.e., open or close) state with an output signal of the decoder 313, which is transmitted to the analog switch 315 via the level shifter 314.

The analog switch 315 is connected to the discrete electrode 153 of the piezoelectric element 121, and receives the drive pulse pattern from the drive pulse generator 301.

Based on a decoding result of the serial image data (e.g., gray-scale data) and droplet control signals M0 to M3 by the decoder 313, the analog switch 315 is shifted to an ON state, and then given drive signals consisting a drive pulse pattern can be selectively transmitted to the piezoelectric element 121.

Hereinafter, a drive pulse pattern generated in the drive pulse generator 301 of the image forming apparatus 100 is explained with reference to FIG. 7.

Figure 7:
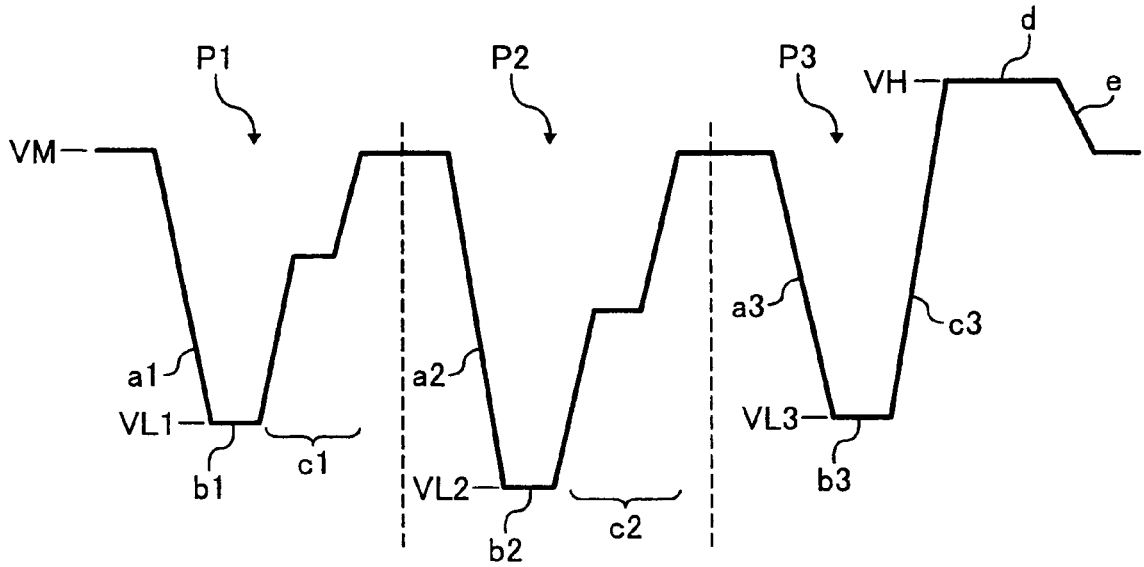
FIG. 7 is a schematic diagram for a drive pulse pattern according to an example of this disclosure.

As shown in FIG. 7, the drive pulse generator 301 generates a drive pulse pattern having a plurality of drive signals such as first, second, and third drive signals P1, P2 and P3 for one-dot print cycle (or one-drive period), wherein the first, second, and third drive signals P1, P2 and P3 are generated sequentially.

Figure 8:
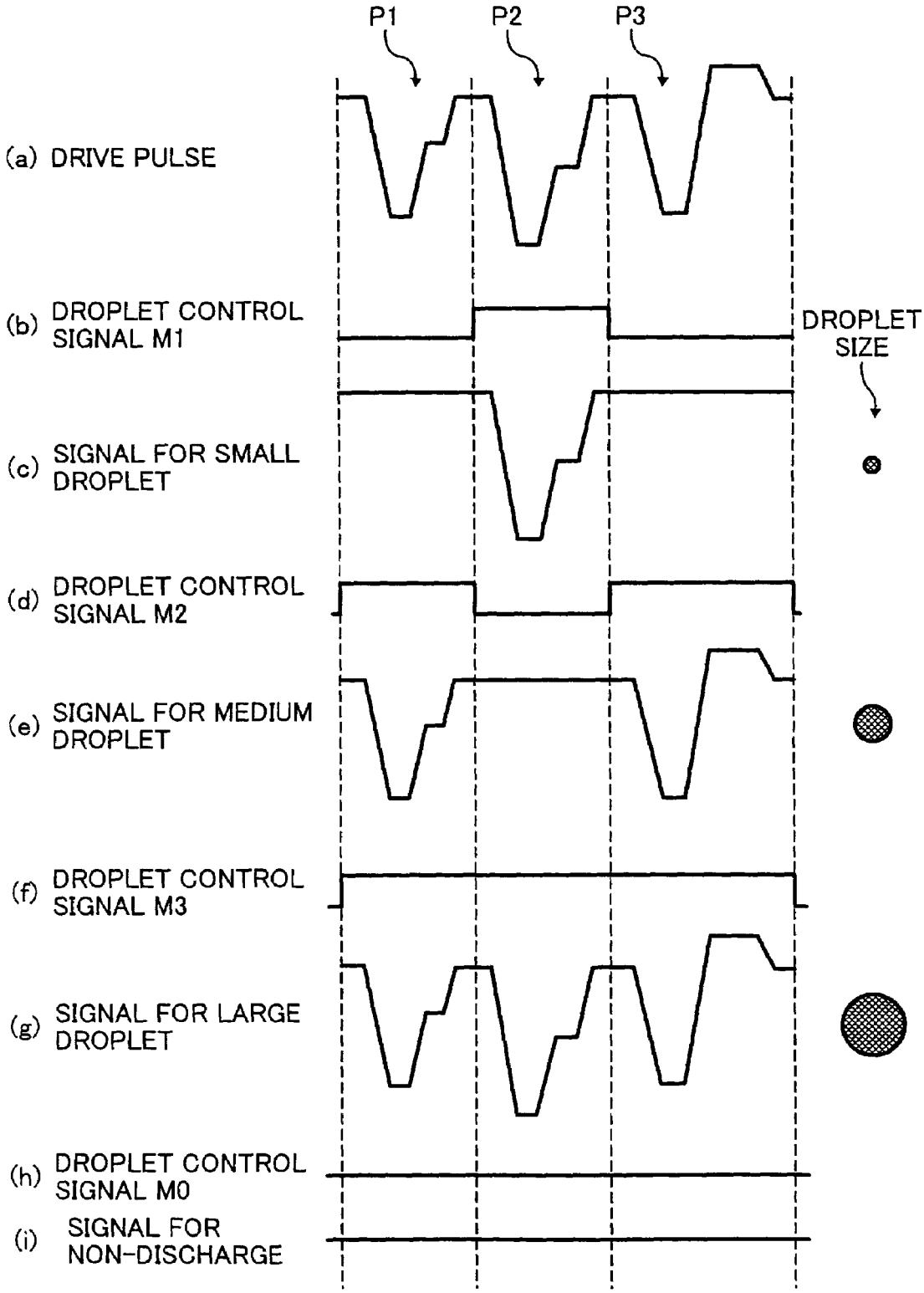
FIG. 8 is a schematic chart for explaining a discharge of different-sized droplets with the drive pulse pattern of FIG. 7.

The data transmission unit 302 can output the droplet control signals M0, M1, M2 and M3 as shown in FIG. 8(*b*), FIG. 8(*d*), FIG. 8(*f*), and FIG. 8(*h*).

Therefore, at least one of the drive signals P1, P2 and P3 can be selected by selecting the droplet control signals M1, M2 and M3, and can be applied to the piezoelectric element 121.

When the droplet control signals M0 is selected, no drive signals is selected as shown in FIG. 8(*h*), by which a drive signal is not applied to the piezoelectric element 121. Accordingly, no droplet is discharged from the recording head 7.

As shown in FIG. 8(*c*), when the second drive signal P2 is selected by the droplet control signal M1, the recording head 7 may discharge a small-sized droplet, by which a smaller dot can be formed on a recording medium.

As also shown in FIG. 8(*e*), when the first drive signal P1 and third drive signal P3 are selected by the droplet control signal M2, the recording head 7 may discharge two types of droplets. Such two types of droplets can be merged together to become a medium-sized droplet when the two types of droplets are traveling through the air, by which a medium-sized dot can be formed on a recording medium.

As also shown in FIG. 8(*g*), when the first, second, and third drive signals P1, P2, and P3 are selected by the droplet control signal M3, the recording head 7 may discharge three types of droplets. Such three types of droplets can be merged together to become a large-sized droplet when the three types of droplets are traveling through the air, by which a larger dot can be formed on a recording medium.

Further, as also shown in FIG. 8(*i*), when the droplet control signal M0 is selected, a droplet is not discharged. Therefore, the droplet control signal M0 is used as a non-discharge signal.

Accordingly, the image forming apparatus 100 can use four gray-scales such as larger, medium-sized, and smaller dots, and no-dot, for example.

Hereinafter, the drive pulse pattern according to an exemplary embodiment is explained in detail with reference to FIG. 7.

The first, second, and third drive signals P1, P2 and P3 shown in FIG. 7 can be used to discharge droplets.

The first, second, and third drive signals P1, P2 and P3 shown in FIG. 7 are examples of drive signals according to an exemplary embodiment. However, numbers and types of drive signals having other shapes can be selected, as required.

Specifically, each of the first, second, and third drive signals P1, P2 and P3 may be applied to the piezoelectric element 121 applied with a medium-level voltage VM in advance.

In case of the drive signal P1, the drive signal P1 is applied to the piezoelectric element 121 to decrease a voltage level from the medium-level voltage VM to a VL1 to increase a volume capacity of the liquid room 106. Then, the voltage level is increased to the medium-level voltage VM again as shown in FIG. 7 to contract the volume capacity of the liquid room 106 so that a droplet can be discharged.

Similarly, in case of the drive signal P2, the drive signal P2 is applied to the piezoelectric element 121 to decrease a voltage level from the medium-level voltage VM to a VL2 to increase a volume capacity of the liquid room 106. Then, the voltage level is increased to the medium-level voltage VM again as shown in FIG. 7 so that a droplet can be discharged.

Similarly, in case of the drive signal P3, the drive signal P3 is applied to the piezoelectric element 121 to decrease a voltage level from the medium-level voltage VM to a VL3 to increase a volume capacity of the liquid room 106. Then, the voltage level is increased to the higher-level voltage VH as shown in FIG. 7 so that a droplet can be discharged. The higher-level voltage VH is greater than the medium-level voltage VM as shown in FIG. 7.

As shown in FIG. 7, the first drive signal P1 includes a signal element al, a signal element b1, and a signal element c1, for example.

During the signal element al, a voltage is decreased from the medium-level voltage VM to a voltage VL1 to increase a volume capacity of the liquid room 106. During the signal element b1, the voltage is maintained at the voltage VL1.

During the signal element c1, the voltage is increased to the medium-level voltage VM gradually.

As also shown in FIG. 7, the second drive signal P2 includes a signal element a2, a signal element b2, and a signal element c2, for example.

During the signal element a2, a voltage is decreased from the medium-level voltage VM to a voltage VL2 to increase a volume capacity of the liquid room 106.

During the signal element b2, the voltage is maintained at the voltage VL2.

During the signal element c2, the voltage is increased to the medium-level voltage VM gradually.

As shown in FIG. 7, the third drive signal P3 includes a signal element a3, a signal element b3, a signal element c3, a signal element d, and a signal element e, for example.

During the signal element a3, a voltage is decreased from the medium-level voltage VM to a voltage VL3 to increase a volume capacity of the liquid room 106.

During the signal element b3, the voltage is maintained at the voltage VL3.

During the signal element c3, the voltage is increased to the higher-level voltage VH, which is higher than the medium-level voltage VM, gradually.

During the signal element d, the voltage is maintained at the higher-level voltage VH.

During the signal element e, the voltage is decreased from the higher-level voltage VH to the middle-level voltage VM.

When each of the first, second, and third drive signals P1, P2, and P3 is applied to the piezoelectric element 121, for example, a droplet can be discharged with a first droplet speed Vj1 for the first drive signal P1, with a second droplet speed Vj2 for the second drive signal P2, and with a third droplet speed Vj3 for the third drive signal P3.

Such first, second, and third droplet speeds Vj1, Vj2, and Vj3 have a relationship of "Vj1<Vj2<Vj3," for example.

Accordingly, the first droplet speed Vj1 for discharging a droplet by the first drive signal P1 is set relatively slower than the droplet speed Vj2 for discharging a droplet by the second drive signal P2.

The above-mentioned relationship of "Vj1<Vj2<Vj3" for droplets is one exemplary relationship according to an exemplary embodiment. However, other relationships may be set depending on condition of an image forming apparatus.

The liquid room 106 (i.e., pressure-generating room) has a pressure change when the first drive signal P1 is applied to discharge a droplet. The liquid room 106 (i.e., pressure-generating room) also has a pressure change when the second drive signal P2 is applied to discharge a droplet.

When applying the first drive signal P1 and the second drive signal P2 in this sequential order, the second drive signal P2 is preferably applied at a timing that the pressure change by the first drive signal P1 and the pressure change by the second drive signal P2 do not resonate each other, for example.

In general, when a voltage is applied to a piezoelectric element to pressurize a liquid room, a vibration having a certain cycle is generated, which may be called "characteristic cycle" for the piezoelectric element, wherein such characteristic cycle is in an order of several micron seconds, for example.

Accordingly, when a voltage is applied to the piezoelectric element 121 to pressurize the liquid room 106, a vibration having a "characteristic cycle" is generated.

When the recording head 7 has a characteristic cycle Tc, the first drive signal P1 is applied at a timing T1, and the second drive signal P2 is applied at a timing T2, a relationship of "T1+Tc<T2<T1+Tc×2" is preferably set.

If the second drive signal P2 is applied at the timing of "T1+Tc" (i.e., first resonance timing), a vibration generated by the first drive signal P1 may resonate with a vibration generated by the second drive signal P2.

If the second drive signal P2 is applied at the timing of "T1+Tc×2" (i.e., second resonance timing), a vibration generated by the first drive signal P1 may resonate with a vibration generated by the second drive signal P2.

Accordingly, a vibration generated by the first drive signal P1 may not resonate with a vibration generated by the second drive signal P2 when the second drive signal P2 is applied at the timing T2 having a relationship of "T1+Tc<T2<T1+Tc×2."

In other words, the second drive signal P2 is applied at the timing T2, which is deviated from the resonance timing of the first drive signal P1, to discharge a droplet.

Figure 9:
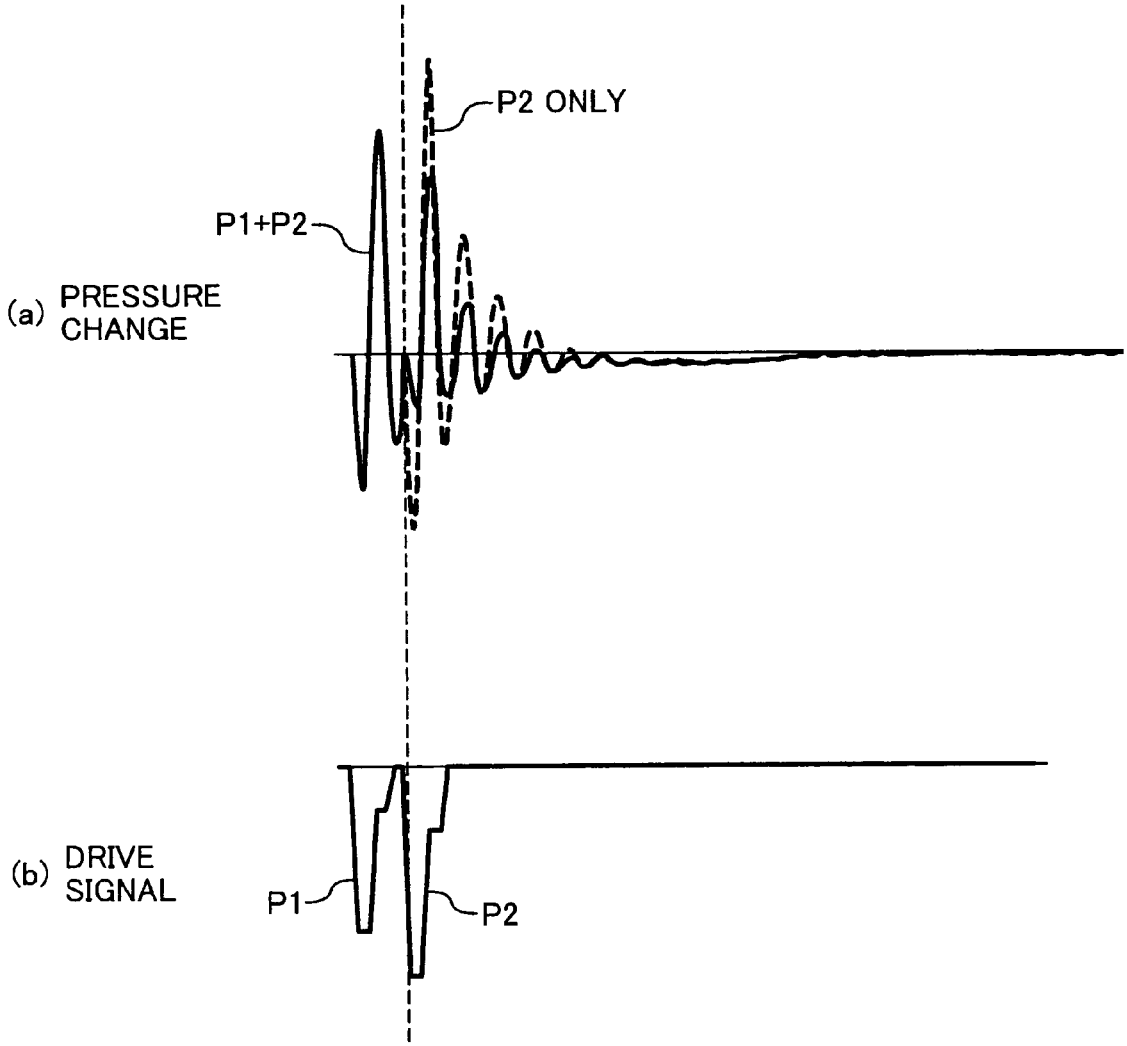
FIG. 9 is a schematic chart for explaining a relationship between a pressure change of a liquid room and drive signals.

For example, FIG. 9 shows an exemplary pressure change when the first drive signal P1 and second drive signal P2 are sequentially applied to the recording head 7 to discharge a droplet.

As shown in FIG. 9, a pressure change in the liquid room 106 which may occur by applying the second drive signal P2 at the timing T2 deviated from the resonance timing of the first drive signal P1 becomes smaller than a pressure change in the liquid room 106 which may occur by only applying the second drive signal P2.

In other words, a pressure change in the liquid room 106 by the second drive signal P2 can be reduced by applying the second drive signal P2 at the timing T2 deviated from the resonance timing of the first drive signal P1. The timing T2 has a relationship of "T1+Tc<T2<T1+Tc×2" as above-mentioned.

Accordingly, a droplet speed Vj12 for a droplet discharged by the second drive signal P2 when the second drive signal P2 is applied at the timing T2 deviated from the resonance timing of the first drive signal P1 may become relatively slower than the second droplet speed Vj2 for a droplet discharged only by the second drive signal P2 (i.e., Vj12<Vj2).

In the exemplary embodiment, droplets discharged by the first, second, and third drive signals P1, P2, and P3 can be merged as one large-sized droplet while the droplets are traveling through the air.

Under such condition, the droplet speed Vj12 for a droplet discharged by the second drive signal P2 applied at the timing T2 deviated from the resonance timing of the first drive signal P1 becomes slower than the second droplet speed Vj2 for a droplet discharged only by the second drive signal P2.

Accordingly, a droplet discharged by the third drive signal P3 can be effectively merged with a droplet discharged by the first drive signal P1, and a droplet discharged by the second drive signal P2, applied at the timing T2 deviated from the resonance timing of the first drive signal P1, while the droplets are traveling through the air, and a resultant one droplet can be impacted on a recording medium as one dot.

Under such configuration, if a droplet speed Vj12 discharged by the second drive signal P2 and first drive signal P1 becomes equal to or faster than the second droplet speed Vj2 discharged only by the second drive signal P2, a droplet discharged by the third drive signal P3 may not catch up and merge the droplet discharged with such droplet speed Vj12.

Therefore, if the droplet speed Vj12 is equal to or faster than the droplet speed Vj2, droplets may impact on a recording medium separately, by which an image may not be formed as one dot.

As such, the drive pulse pattern according to an exemplary embodiment includes at least the first and second drive signal P1 and P2, which are applied sequentially.

Further, as above described, the droplet speed Vj12 for a droplet discharged by the second drive signal P2 when the second drive signal P2 is applied at the timing T2 deviated from the resonance timing of the first drive signal P1 can be set relatively slower than the second droplet speed Vj2 for a droplet discharged only by the second drive signal P2.

With such speed control of discharged droplets, a plurality of droplets can be effectively merged together while they are traveling through the air, and such merged droplets can be impacted on a recording medium as one droplet, by which each one-dot image can be formed by such one droplet on the recording medium. Accordingly, a deviation of impact positions by discharged droplets that forms a resultant one dot can be suppressed.

Further, a large-sized droplet can be formed with a plurality of drive signals including a drive signal for small-sized droplet, and a drive signal for medium-sized droplet.

If each of large-sized droplet, medium-sized droplet, and small-sized droplet is formed by separate drive pulses, a drive pulse pattern needs to include a relatively greater number of drive pulses. For example, if three drive pulses are required for forming a large-sized droplet, two drive pulses are required for forming a medium-sized droplet, and one drive pulse is required for forming a small-sized droplet, a drive pulse pattern needs to include six pulses to generate a small-sized droplet, a medium-sized droplet, and a large-sized droplet, by which such drive pulse pattern needs a relatively longer time for one cycle of the drive pulse pattern.

On one hand, if a large-sized droplet can be formed by three drive pulses including drive pulses for small-sized droplet and medium-sized droplet, for example, a drive pulse pattern needs a relatively shorter time for one cycle of the drive pulse pattern.

In an exemplary embodiment, a large-sized droplet can be formed with a plurality of drive signals including a drive signal for small-sized droplet, and a drive signal for medium-sized droplet. Therefore, for one-dot print cycle (or one-drive period) of a drive pulse pattern can be set to a relatively shorter period of time, and thereby a high quality image can be formed with a higher speed.

Further, as above described, the droplet speed Vj12 for a droplet discharged by the second drive signal P2 and first drive signal P1 can be set relatively slower than the second droplet speed Vj2 for a droplet discharged only by the second drive signal P2 by simply applying the second drive signal P2 at the timing T2 deviated from the resonance timing of the first drive signal P1. Accordingly, the image forming apparatus 100 can conduct such speed control without using a specially designed device.

Further, the drive pulse pattern according an exemplary embodiment may further include the third drive signal P3 after the second drive signal P2, which are generated sequentially.

When each of the first, second, and third drive signals P1, P2, and P3 is applied to the piezoelectric element 121, a droplet can be discharged with a first droplet speed Vj1 for the first drive signal P1, with a second droplet speed Vj2 for the second drive signal P2, and with a third droplet speed Vj3 for the third drive signal P3.

Such first, second and third droplet speeds Vj1, Vj2, and Vj3 have a relationship of "Vj1<Vj2<Vj3," for example.

Accordingly, the first droplet speed Vj1 for discharging a droplet by the first drive signal P1 is set relatively slower than the droplet speed Vj2 for discharging a droplet by the second drive signal P2.

With such speed control of discharged droplets, a plurality of droplets can be effectively merged together while they are traveling through the air, and such merged droplets can be impacted on a recording medium as one droplet, by which each one-dot image can be formed by such one droplet on the recording medium. Accordingly, a deviation of impact positions by discharged droplets that forms the resultant one dot can be suppressed.

Further, a large-sized droplet can be formed with a plurality of drive signals including a drive signal for small-sized droplet, and a drive signal for medium-sized droplet. Therefore, for one-dot print cycle (or one-drive period) of a drive pulse pattern can be set to a relatively shorter period of time.

The first, second, and third drive signals P1, P2 and P3 can be selectively combined together to set a drive pulse pattern, which is used for discharging droplets having different-sized droplets such as larger-sized droplet, medium-sized droplet and smaller-sized droplet on the recording medium.

Such larger-sized droplet, medium-sized droplet and smaller-sized droplet can be impacted on a substantially same position on the recording medium as larger dot, medium-sized dot and smaller dot.

Such discharged droplets can be impacted on a recording medium as one droplet, by which each one-dot image can be formed by such one droplet on the recording medium. Accordingly, a deviation of impact positions by discharged droplets that forms a resultant one dot can be suppressed.

Accordingly, an image having formed by such small-sized droplet, medium-sized droplet, and large-sized droplet can be reproduced with a higher image quality.

Further, the image forming apparatus 100 according to an example can conduct a bi-directional printing operation with a higher speed because a deviation of impact positions by discharged droplets can be suppressed as above-mentioned.

As above-mentioned, the first, second, and third drive signals P1, P2 and P3 are combined together to discharge a larger droplet, by which a larger dot can be formed on the recording medium.

In an exemplary embodiment, a large-sized droplet can be formed with a plurality of drive signals including a drive signal for small-sized droplet, and a drive signal for medium-sized droplet.

Therefore, a cycle of a drive pulse pattern can be set to a relatively shorter period of time, and a small-sized droplet, medium-sized droplet, and large-sized droplet can be impacted on a substantially same position on a recording sheet.

Further, the second drive signal P2 can be used for forming a smaller droplet, by which a smaller dot can be formed on the recording medium. Therefore, a large-sized droplet can be formed with a plurality of drive signals including a drive signal for small-sized droplet.

Accordingly, a cycle of a drive pulse pattern can be set to a relatively shorter period of time, and a small-sized droplet, medium-sized droplet, and large-sized droplet can be impacted on a substantially same position on a recording sheet.

Further, a combination of the first and third drive signals P1 and P3 can be used to discharge the medium-sized droplet while the larger-sized droplet is discharged by combining the first, second and third drive signals P1, P2, and P3, and the smaller-sized droplet is discharged by the second drive signal P2.

Therefore, a large-sized droplet can be formed with a plurality of drive signals including a drive signal for medium-sized droplet.

Accordingly, a cycle of a drive pulse pattern can be set to a relatively shorter period of time, and a small-sized droplet, medium-sized droplet, and large-sized droplet can be impacted on a substantially same position on a recording sheet.

In an exemplary embodiment, a medium-sized droplet can be discharged with a combination of the first drive signal P1 and third drive signal P3 as shown in FIG. 8(*e*).

Figure 10:
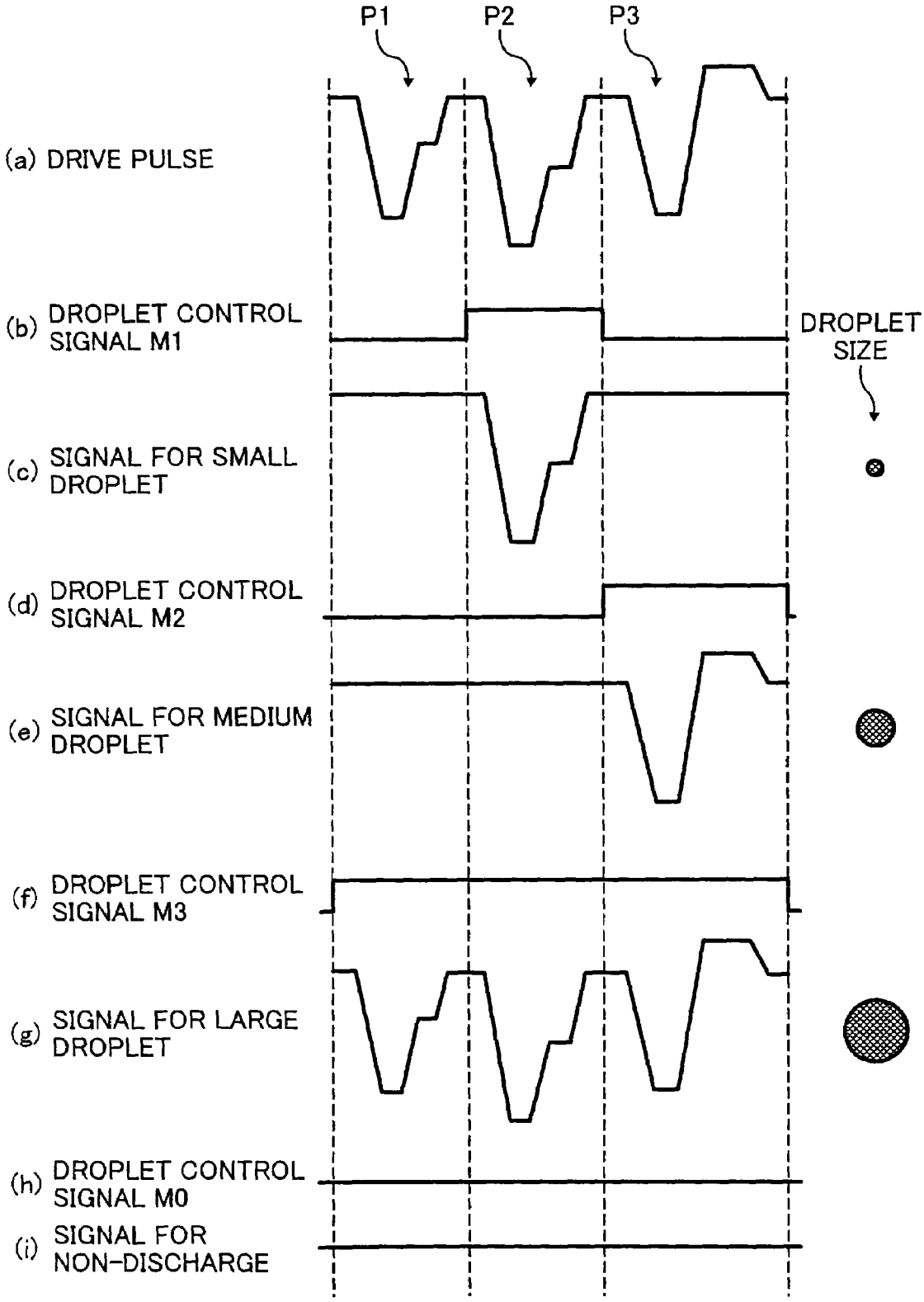
FIG. 10 is another schematic chart for explaining a discharge of different-sized droplets with a drive pulse pattern of FIG. 7.

However, a medium-sized droplet can be discharged only by the third drive signal P3 as shown in FIGS. 10(*d*) and 10(*e*). The medium-sized droplet discharged only by the third drive signal P3 can be preferably made smaller than the medium-sized droplet discharged by a combination of the above-mentioned first drive signal P1 and third drive signal P3.

As such, the third drive signal P3 can be used to discharge the medium-sized droplet while the larger-sized droplet is discharged by combining the first, second and third drive signals P1, P2 and P3, and the smaller-sized droplet is discharged by the second drive signal P2.

Therefore, a large-sized droplet can be formed with a plurality of drive signals including a drive signal for small-sized droplet and a drive signal for medium-sized droplet.

Accordingly, a cycle of a drive pulse pattern can be set to a relatively shorter period of time, and a small-sized droplet, medium-sized droplet, and large-sized droplet can be impacted on a substantially same position on a recording sheet.

Hereinafter, a drive pulse pattern generated in the drive pulse generator 301 according to another exemplary embodiment is explained with reference to FIG. 11.

Figure 11:
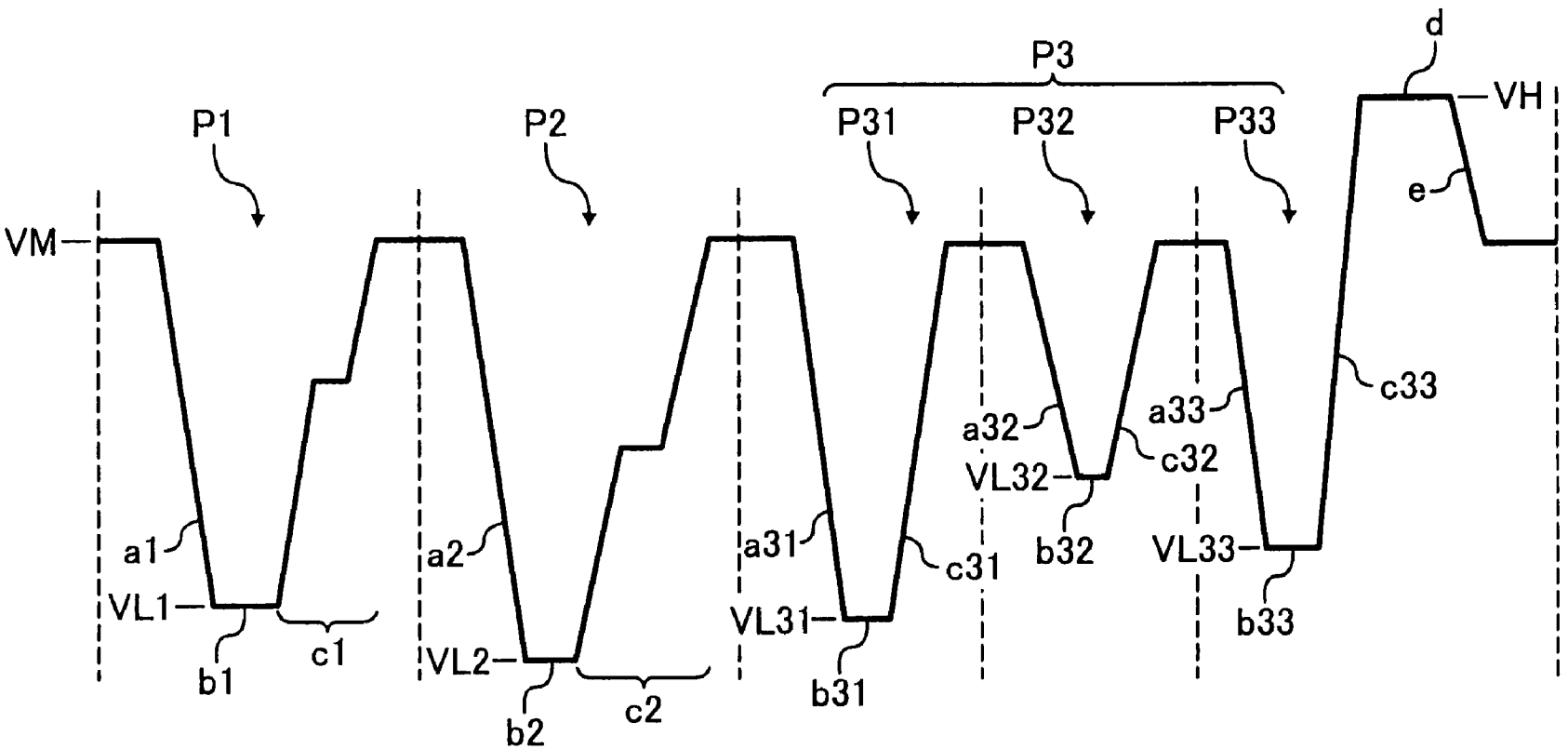
FIG. 11 is a schematic diagram for a drive pulse pattern according to another example.

As shown in FIG. 11, the drive pulse generator 301 generates a drive pulse pattern having a plurality of drive signals such as first, second, and third drive signals (or drive pulses) P1, P2, and P3 for one-dot print cycle (or one-drive period), wherein the first, second, and third drive signals P1, P2, and P3 are generated sequentially.

Further, in another exemplary embodiment shown in FIG. 11, the third drive signal P3 includes a plurality of sub-drive signals. Specifically, the third drive signal P3 includes three sub-drive signals P31, P32, and P33, for example.

As shown in FIG. 11, the sub-drive signal P31 of the third drive signal P3 includes a signal element a31, a signal element b31, and a signal element c31, for example.

During the signal element a31, a voltage is decreased from the medium-level voltage VM to a voltage VL31 to increase a volume capacity of the liquid room 106.

During the signal element b31, the voltage is maintained at the voltage VL31.

During the signal element c31, the voltage is increased to the medium-level voltage VM gradually.

Further, as also shown in FIG. 11, the sub-drive signal P32 of the third drive signal P3 includes a signal element a32, a signal element b32, and a signal element c32, for example.

During the signal element a32, a voltage is decreased from the medium-level voltage VM to a voltage VL32 to increase a volume capacity of the liquid room 106.

During the signal element b32, the voltage is maintained at the voltage VL32.

During the signal element c32, the voltage is increased to the medium-level voltage VM gradually.

The sub-drive signal P32 may be applied to the piezoelectric element 121 to change a pressure in the liquid room 106, but may not be used to discharge a droplet from the recording head 7. Specifically, the sub-drive signal P32 may be used as a minute-drive signal, which only vibrates a meniscus of recording liquid.

With such minute-drive signal, a viscosity increase of recording liquid at the nozzle can be suppressed.

Further, as also shown in FIG. 11, the sub-drive signal P33 of the third drive signal P3 includes a signal element a33, a signal element b33, a signal element c33, a signal element d, and a signal element e, for example, similarly to the third drive signal P3 shown in FIG. 7.

During the signal element a33, a voltage is decreased from the medium-level voltage VM to a voltage VL33 to increase a volume capacity of the liquid room 106.

During the signal element b33, the voltage is maintained at the voltage VL33.

During the signal element c33, the voltage is increased to a higher-level voltage VH, which is higher than the medium-level voltage VM, gradually.

During the signal element d, the voltage is maintained at the higher-level voltage VH.

During the signal element e, the voltage is decreased from the higher-level voltage VH to the medium-level voltage VM.

When each of the first drive signal P1, second drive signal P2, sub-drive signal P31, and sub-drive signal P33 is applied to the piezoelectric element 121, a droplet is discharged with a droplet speed Vj1 for the first drive signal P1, with a droplet speed Vj2 for the second drive signal P2, with a droplet speed Vj31 for the sub-drive signal P31, and with a droplet speed Vj33 for the sub-drive signal P33.

Such droplet speeds Vj1, Vj2, Vj31 and Vj33 have a relationship of "Vj1<Vj2<Vj31<Vj33," for example.

As shown in FIG. 11, the first drive signal P1 and second drive signal P2 has a relationship similar to the relationship explained in the above-described exemplary embodiment shown in FIG. 7.

A large-sized droplet, medium-sized droplet, and small-sized droplet can be formed with the drive pulse pattern shown in FIG. 11 as below.

Figure 12:
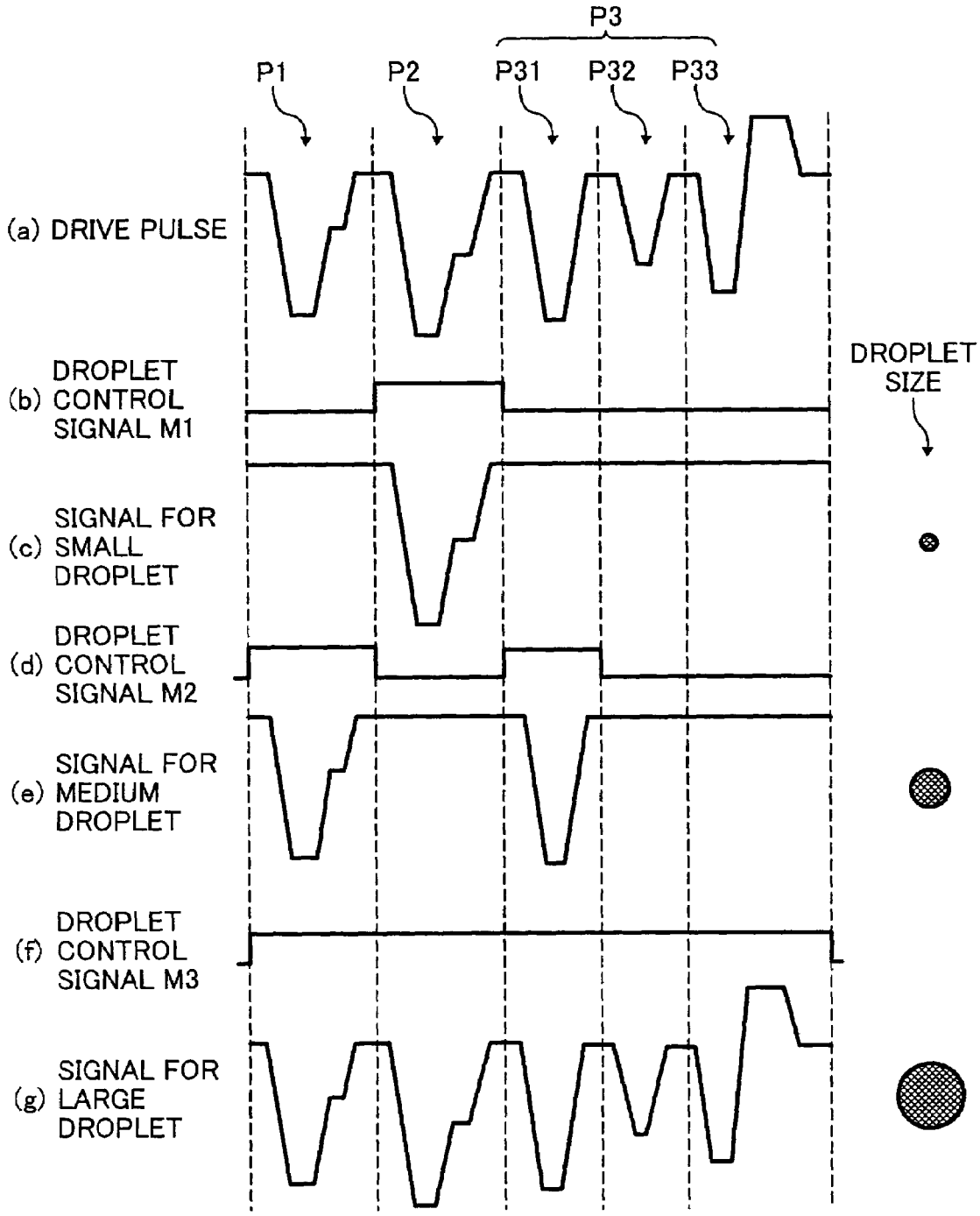
FIG. 12 is another schematic chart for explaining a discharge of different-sized droplets with the drive pulse pattern of FIG. 11.

For example, as shown in FIG. 12(*c*), when the second drive signal P2 is selected by the droplet control signal M1, the recording head 7 may discharge a small-sized droplet, by which a smaller dot can be formed on a recording medium.

As also shown in FIG. 12(*e*), when the first drive signal P1 and sub-drive signal P31 are selected by the droplet control signal M2, the recording head 7 may discharge two types of droplets. Such two types of droplets can be merged together as one medium-sized droplet when the two types of droplets are traveling through the air, by which a medium-sized dot can be formed on a recording medium.

As also shown in FIG. 12(*g*), when the first, second, and third drive signals P1, P2, and P3 (including P31 to P33) are selected by the droplet control signal M3, the recording head 7 may discharge droplets, which correspond to the drive signals P1, P2, and P3. Such droplets can be merged together as a large-sized droplet when the droplets are traveling through the air, by which a larger dot can be formed on a recording medium.

As such, the third drive signal P3 includes a plurality of sub-drive signals such as sub-drive signals P31, P32, and P33.

In another exemplary embodiment, one of the sub-drive signals of the P3 can be combined with the first drive signal P1 to discharge droplets to be merged as a medium-sized droplet while a larger-sized droplet is discharged by combining the first, second and third drive signals P1, P2 and P3, and the smaller-sized droplet is discharged by the second drive signal P2.

Therefore, a large-sized droplet can be formed with a plurality of drive signals including a drive signal for small-sized droplet, and a drive signal for medium-sized droplet.

Accordingly, a cycle of a drive pulse pattern can be set to a relatively shorter period of time, and a small-sized droplet, medium-sized droplet, and large-sized droplet can be impacted on a substantially same position on a recording sheet.

Figure 13:
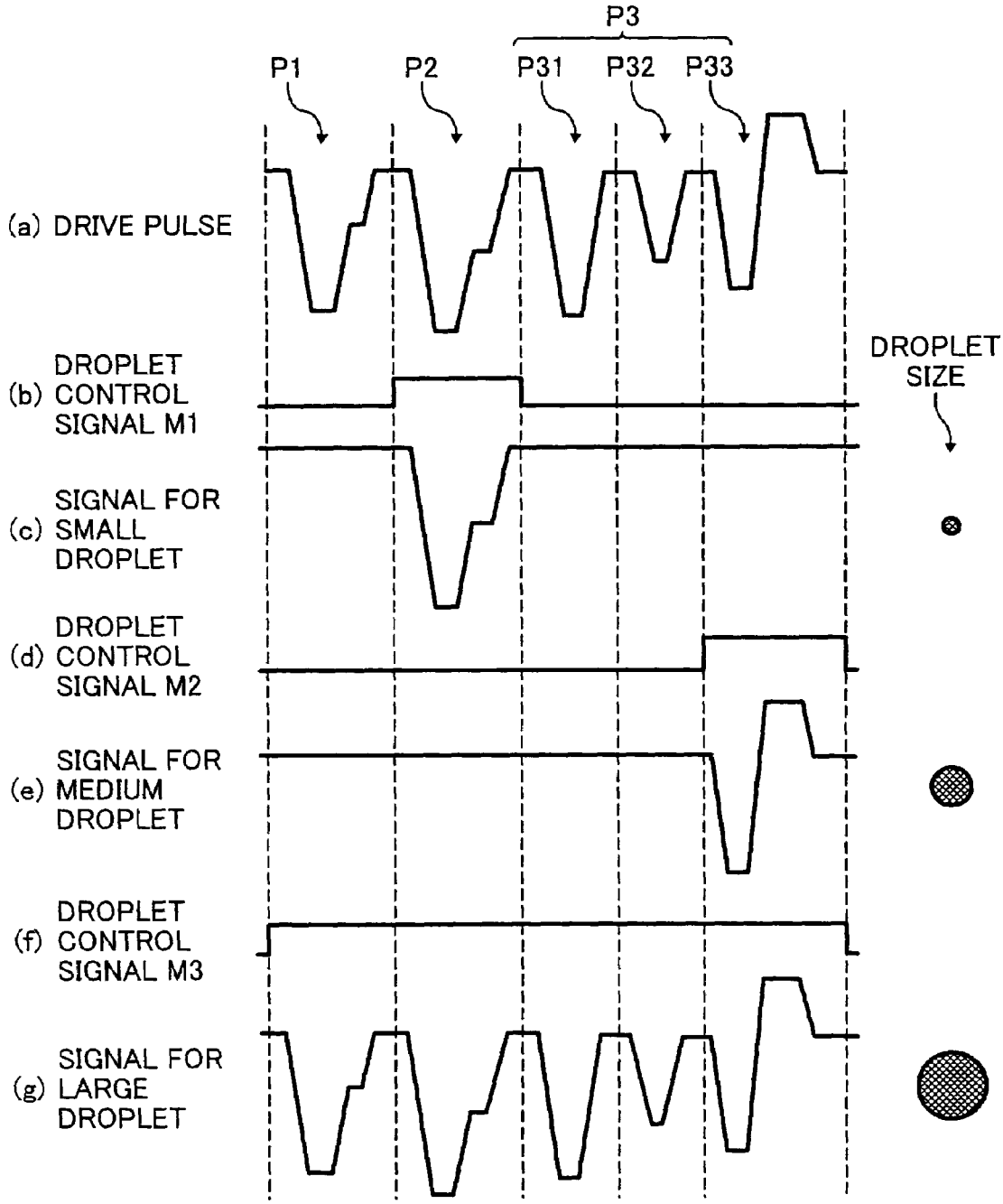
FIG. 13 is another schematic chart for explaining a discharge of different-sized droplets with the drive pulse pattern of FIG. 11.

Further, as shown in FIG. 13(*e*), the sub-drive signal P33 included in the third drive signal P3 can be selected by the droplet control signal M2 to discharge a medium-sized droplet from the recording head 7.

As such, in another exemplary embodiment, one of the sub-drive signals of the P3 can be used to discharge a medium-sized droplet while a larger-sized droplet is discharged by combining the first, second and third drive signals P1, P2 and P3, and the smaller-sized droplet is discharged by the second drive signal P2.

Therefore, a large-sized droplet can be formed with a plurality of drive signals including a drive signal for small-sized droplet and a drive signal for medium-sized droplet.

Accordingly, a cycle of a drive pulse pattern can be set to a relatively shorter period of time, and a small-sized droplet, medium-sized droplet, and large-sized droplet can be impacted on a substantially same position on a recording sheet.

Figure 14:
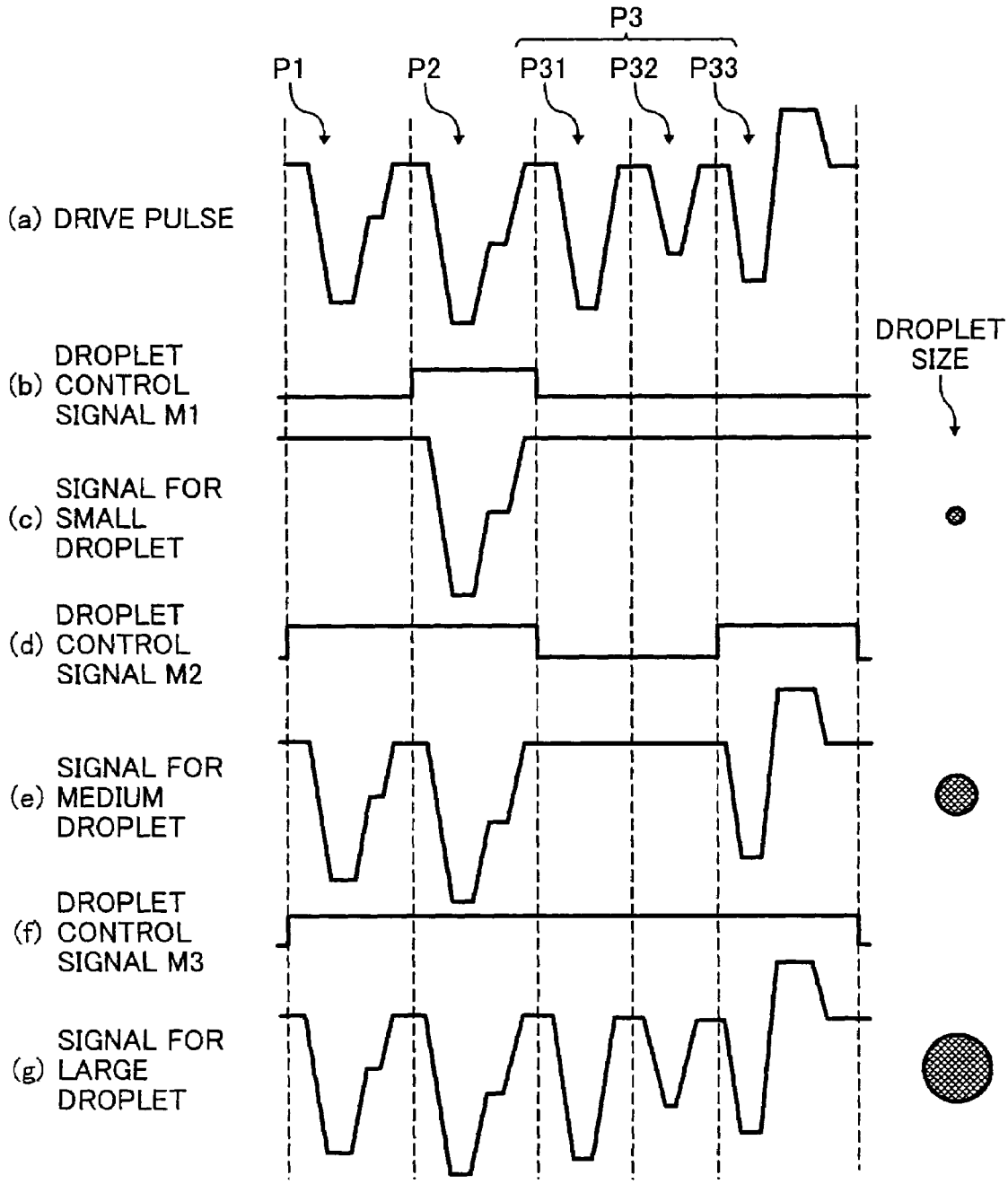
FIG. 14 is another schematic chart for explaining a discharge of different-sized droplets with the drive pulse pattern of FIG. 11.

Further, as shown in FIG. 14(*e*), the first drive signal P1, second drive signal P2, and sub-drive signal P33 included in the third drive signal P3 can be selected with the droplet control signal M2 to discharge a medium-sized droplet from the recording head 7.

As such, in another exemplary embodiment, one of the sub-drive signals of the P3 can be combined with the first drive signal P1 and second drive signal P2 to discharge droplets to be merged as a medium-sized droplet while a larger-sized droplet is discharged by combining the first, second and third drive signals P1, P2 and P3, and the smaller-sized droplet is discharged by the second drive signal P2.

Therefore, a large-sized droplet can be formed with a plurality of drive signals including a drive signal for small-sized droplet, and a drive signal for medium-sized droplet.

Accordingly, a cycle of a drive pulse pattern can be set to a relatively shorter period of time, and a small-sized droplet, medium-sized droplet, and large-sized droplet can be impacted on a substantially same position on a recording sheet.

In the above-described exemplary embodiment, three drive signals P1 to P3 are used for one-dot print cycle (or one-drive period) for discharging droplets. However, numbers of drive signals can be changed, as required, and some drive signals for one-print cycle may not be used for discharging droplets.

In the above-described exemplary embodiment, the image forming apparatus 100 includes a printer, which can process data in a serial manner. However, the image forming apparatus 100 can also include other types of apparatuses such as multifunctional apparatus having printer/facsimile/copier function, which can process data in a serial manner, and an image forming apparatus having a line head for recording images.

Numerous additional modifications and variations are possible in light of the above teachings. It is therefore to be understood that within the scope of the appended claims, the subject matter of the present disclosure may be practiced otherwise than as specifically described herein. For example, elements and/or features of different examples and illustrative embodiments may be combined with each other and/or substituted for each other within the scope of this disclosure and appended claims.

This application claims priority from Japanese patent applications No. 2005-297387 filed on Oct. 12, 2005 in the Japan Patent Office, the entire contents of which is hereby incorporated by reference herein.

What is claimed is:

1. An image forming apparatus, comprising:

a recording head, comprising:

a nozzle configured to discharge a droplet of recording liquid;

a pressure-generating room configured to store the recording liquid and communicate with the nozzle; and a pressure-generating device configured to change a pressure condition of the recording liquid in the pressure-generating room; and a drive pulse generator configured to generate a drive pulse pattern having a plurality of drive signals generated sequentially, the plurality of drive signals being selectively applied to the pressure-generating device, wherein the plurality of drive signals include at least a first drive signal and a second drive signal, generated sequentially, and a discharge speed of a droplet discharged by applying a combination of the first and second drive signals to the pressure-generating device is set to be slower than a discharge speed of a droplet discharged by applying the second drive signal alone, without applying the first driving signal, to the pressure-generating device, wherein a drive signal applied to the pressure-generating device causes the pressure-generating room to vibrate with a characteristic vibration cycle Tc, and wherein the first drive signal is applied at a timing T1 and the second drive signal is applied at a timing T2 such that $T1+Tc < T2 < T1+Tc\times 2$.

2. The image forming apparatus according to claim 1, wherein the second drive signal applied alone as a drive signal, without applying the first driving signal, discharges a smaller droplet to form a smaller dot on a recording medium than said droplet discharged by applying the combination of the first and second drive signals.

3. The image forming apparatus of claim 1, wherein said first drive signal in said combination causes a first droplet to be discharged, and said second drive signal in said combination causes a second droplet to be discharged, and said first droplet and said second droplet merge while traveling through the air.

4. The image forming apparatus according to claim 1, wherein the first drive signal is applied to the pressure-generating device to cause the pressure-generating room to vibrate with an associated resonance timing, and the second drive signal is subsequently applied to the pressure-generating device at a timing deviating from the associated resonance timing caused by the first drive signal.

5. The image forming apparatus of claim 4, wherein a pressure change in the pressure-generating room caused by applying the second drive signal at the timing deviating from the associated resonance timing caused by the first drive signal is smaller than a pressure change caused by applying the second drive signal alone, without applying the first drive signal.

6. The image forming apparatus according to claim 1, wherein the drive pulse pattern further includes a third drive signal after the second drive signal, and a discharge speed of a droplet discharged by the first drive signal is set to be slower than a discharge speed of a droplet discharged by the second drive signal, and droplets discharged by the first, second, and third drive signals merge together while traveling through air and before reaching a recording medium.

7. The image forming apparatus according to claim 6, wherein the first, second and third drive signals are selectively combined together to form a drive pulse combination for discharging different-sized droplets including larger-sized droplet, medium-sized droplet, and smaller-sized droplet, by which corresponding different-sized dots including larger dot, medium-sized dot and smaller dot are formed on a recording medium, and the different-sized droplets including larger-sized droplet, medium-sized droplet and smaller-sized droplet are impacted on a substantially same position on the recording medium.

8. The image forming apparatus according to claim 7, wherein the first, second and third drive signals are combined together to discharge a larger droplet to form a larger dot on a recording medium.

9. The image forming apparatus according to claim 6, wherein the third drive signal includes a plurality of sub-drive signals, and at least one of the plurality of sub-drive signals is combined with the first drive signal to discharge droplets to be merged together while traveling through air to form a medium-sized droplet before reaching a recording medium, and wherein a larger-sized droplet is formed by a combination of the first, second, and third drive signals, and a smaller-sized droplet is formed by applying the second drive signal alone.

10. The image forming apparatus according to claim 6, wherein the third drive signal includes a plurality of sub-drive signals, at least one of the plurality of sub-drive signals is used to form a medium-sized droplet, a larger-sized droplet is formed by a combination of the first, second and third drive signals, and a smaller-sized droplet is formed by applying the second drive signal alone.

11. The image forming apparatus according to claim 6, wherein the third drive signal includes a plurality of sub-drive signals, and at least one of the plurality of sub-drive signals is combined with the first drive signal and second drive signal to discharge droplets to be merged together while traveling through air to form a medium-sized droplet before reaching the recording medium, and wherein a larger-sized droplet is formed by applying a combination of the first, second and third drive signals, and a smaller-sized droplet is formed by applying the second drive signal alone.

12. The image forming apparatus according to claim 6, wherein the third drive signal includes a plurality of sub-drive signals, and at least one of the plurality of sub-drive signals is used for vibrating a meniscus of the recording liquid in the pressure-generating room without discharging a droplet of the recording liquid.

13. The image forming apparatus according to claim 6, wherein the first drive signal and third drive signal are combined together to discharge droplets to be merged together while traveling through air to form a medium-sized droplet before reaching the recording medium, and wherein a larger-sized droplet is formed by applying a combination of the first, second and third drive signals, and a smaller-sized droplet is formed by applying the second drive signal alone.

14. The image forming apparatus according to claim 6, wherein the third drive signal is used to discharge a medium-sized droplet, a larger-sized droplet is formed by applying a combination of the first, second, and third drive signals, and a smaller-sized droplet is formed by applying the second drive signal alone.

15. An image forming apparatus, comprising:

a recording head, comprising:

a nozzle configured to discharge a droplet of recording liquid;

a pressure-generating room configured to store the recording liquid and communicate with the nozzle; and pressure changing means for changing a pressure condition of the recording liquid in the pressure-generating room; and drive pulse pattern generating means for generating a drive pulse pattern having a plurality of drive signals generated sequentially, the plurality of drive signals being selectively applied to the pressure changing means, wherein the plurality of drive signals include at least a first drive signal and a second drive signal, generated sequentially, and a discharge speed of a droplet discharged by applying a combination of the first and second drive signals to the pressure changing means is slower than a discharge speed of a droplet discharged by applying the second drive signal alone, without applying the first drive signal, to the pressure changing means, wherein a drive signal applied to the pressure-generating device causes the pressure-generating room to vibrate with a characteristic vibration cycle Tc, and wherein the first drive signal is applied at a timing $T_1$ and the second drive signal is applied at a timing $T_2$ such that $T_1+Tc < T_2 < T_1+Tc\times 2$.

* * * * *